US008911172B2

(12) United States Patent
Castro et al.

(10) Patent No.: US 8,911,172 B2
(45) Date of Patent: Dec. 16, 2014

(54) APPARATUSES, SYSTEMS AND METHODS FOR SELECTIVELY AFFECTING MOVEMENT OF A MOTOR VEHICLE

(71) Applicant: Pacific Scientific Energetic Materials Company (Arizona), LLC, Chandler, AZ (US)

(72) Inventors: Mynor J. Castro, Chandler, AZ (US); Robert A. McCoy, Phoenix, AZ (US); William G. Seeglitz, Glendale, AZ (US); Edwin A. Spomer, Peoria, AZ (US)

(73) Assignee: Pacific Scientific Energetic Materials Company, Chandler, AZ (US)

( * ) Notice: Subject to any disclaimer, the term of this patent is extended or adjusted under 35 U.S.C. 154(b) by 0 days.

(21) Appl. No.: 13/925,561

(22) Filed: Jun. 24, 2013

(65) Prior Publication Data

US 2014/0126959 A1 May 8, 2014

Related U.S. Application Data

(63) Continuation of application No. 12/886,499, filed on Sep. 20, 2010, now Pat. No. 8,469,627, which is a continuation-in-part of application No. 12/569,872, filed on Sep. 29, 2009, now Pat. No. 8,186,905.

(60) Provisional application No. 61/253,510, filed on Oct. 20, 2009, provisional application No. 61/101,142, filed on Sep. 29, 2008.

(51) Int. Cl.
*E01F 13/12* (2006.01)

(52) U.S. Cl.
CPC ..... *E01F 13/12* (2013.01)
USPC ..... 404/6

(58) Field of Classification Search
CPC ..... E01F 13/12
USPC ..... 404/6, 9
See application file for complete search history.

(56) References Cited

U.S. PATENT DOCUMENTS

| | | | |
|---|---|---|---|
| 3,456,920 | A | 7/1969 | Elvington |
| 5,322,385 | A | 6/1994 | Reisman |
| 5,330,285 | A | 7/1994 | Greves et al. |
| 5,452,962 | A | 9/1995 | Greves |
| 5,507,588 | A | 4/1996 | Marts et al. |
| RE35,373 | E | 11/1996 | Kilgrow et al. |
| 5,775,832 | A | 7/1998 | Kilgrow et al. |

(Continued)

FOREIGN PATENT DOCUMENTS

| | | | |
|---|---|---|---|
| WO | WO 2005/093163 | A2 | 10/2005 |
| WO | WO 2009/090370 | A1 | 7/2009 |

OTHER PUBLICATIONS

International Application No. PCT/US2009/058892, International Search Report and Written Opinion, 10 pages, Nov. 19, 2009.

(Continued)

*Primary Examiner* — Raymond W Addie
(74) *Attorney, Agent, or Firm* — Perkins Coie LLP

(57) ABSTRACT

A non-lethal vehicle device provides for the selective, remotely-deployed controlled stop of a targeted vehicle regardless of wheel or undercarriage configuration. The device is comprised of a combination of a remote arm/safe mechanism, a remote deployment controller, spike/snare deployment mechanism(s), a "speed bump" type housing that can protrude (be driven over until deployed) or be submerged, and one or more snares with a plurality of spikes. A combination of sensors may provide independent deployment once armed.

15 Claims, 29 Drawing Sheets

(56) References Cited

U.S. PATENT DOCUMENTS

| | | | |
|---|---|---|---|
| 5,820,293 | A | 10/1998 | Groen et al. |
| 5,839,849 | A | 11/1998 | Pacholok et al. |
| 5,871,300 | A | 2/1999 | Ingham |
| 5,890,832 | A | 4/1999 | Soleau |
| 5,904,443 | A | 5/1999 | Soleau |
| 6,155,745 | A | 12/2000 | Groen et al. |
| 6,206,608 | B1 | 3/2001 | Blevins |
| 6,220,781 | B1 | 4/2001 | Miller |
| 6,224,291 | B1 | 5/2001 | Mateychuk |
| 6,322,285 | B1 | 11/2001 | Ben |
| 6,409,420 | B1 | 6/2002 | Horton et al. |
| 6,474,903 | B1 | 11/2002 | Marts et al. |
| 6,527,475 | B1 | 3/2003 | Lowrie |
| 6,551,013 | B1 | 4/2003 | Blair |
| 6,623,205 | B1 | 9/2003 | Ramirez |
| 6,716,234 | B2 | 4/2004 | Grafton et al. |
| 6,758,628 | B1 | 7/2004 | Curry, Jr. |
| 6,997,638 | B2 | 2/2006 | Hensley et al. |
| 7,011,470 | B1 | 3/2006 | Breazeale et al. |
| 7,025,526 | B2 | 4/2006 | Blair |
| 7,201,531 | B2 | 4/2007 | Shackelford et al. |
| 7,220,076 | B2 | 5/2007 | Boll |
| 7,226,238 | B2 | 6/2007 | Collier |
| 7,441,982 | B1 | 10/2008 | Al-Sabah |
| 7,524,134 | B2 | 4/2009 | Rastegar et al. |
| 7,573,379 | B2 | 8/2009 | Moormeier et al. |
| 7,736,086 | B2 | 6/2010 | Coomber et al. |
| 7,785,032 | B2 | 8/2010 | Segal |
| 7,862,251 | B2 | 1/2011 | Lyddon et al. |
| 7,946,785 | B2 | 5/2011 | Grosch |
| 2005/0214071 | A1 | 9/2005 | Collier |
| 2005/0244223 | A1 | 11/2005 | Shackelford et al. |
| 2006/0140715 | A1 | 6/2006 | Lyddon et al. |
| 2006/0260210 | A1 | 11/2006 | Tanielian et al. |
| 2007/0264079 | A1 | 11/2007 | Martinez et al. |
| 2008/0060271 | A1 | 3/2008 | Beniamin et al. |
| 2008/0124171 | A1 | 5/2008 | Moormeier et al. |
| 2009/0163095 | A1 | 6/2009 | Weinel et al. |
| 2010/0086349 | A1 | 4/2010 | Martinez et al. |
| 2010/0196092 | A1 | 8/2010 | Castro et al. |
| 2010/0221066 | A1 | 9/2010 | Martinez et al. |

OTHER PUBLICATIONS

International Application No. PCT/US2009/059554, International Search Report and Written Opinion, 11 pages, Dec. 4, 2009.

International Application No. PCT/US2010/053425, International Search Report and Written Opinion, 11 pages, Dec. 13, 2010.

International Application No. PCT/US2010/053428, International Search Report and Written Opinion, 8 pages, Dec. 13, 2010.

Japanese Patent Application No. 2011-529376, Office Action, 11 pages, Aug. 21, 2013.

European Patent Application No. EP 10827334.3, Supplementary European Search Report, 5 pages, Jun. 11, 2014.

APPARATUSES, SYSTEMS AND METHODS FOR SELECTIVELY AFFECTING MOVEMENT OF A MOTOR VEHICLE

CROSS-REFERENCE TO RELATED APPLICATIONS

This application is a continuation of U.S. patent application Ser. No. 12/886,499, filed Sep. 20, 2010, entitled "Apparatuses, Systems And Methods For Selectively Affecting Movement Of A Motor Vehicle," now allowed, which claims the benefit under 35 U.S.C. §119 of U.S. Provisional Patent Application No. 61/253,510, filed Oct. 20, 2009, entitled "Apparatuses, Systems And Methods For Selectively Affecting Movement Of A Motor Vehicle," and which is a continuation-in-part of U.S. patent application Ser. No. 12/569,872, filed Sep. 29, 2009, entitled "Apparatuses, Systems And Methods For Selectively Affecting Movement Of A Motor Vehicle," issued as U.S. Pat. No. 8,186,905, which claims the benefit under 35 U.S.C. §119 of U.S. Provisional Patent Application No. 61/101,142, filed Sep. 29, 2008, entitled "System And Method For Motor Vehicle Restraint," each of which are incorporated herein in their entirety by reference.

TECHNICAL FIELD

The present disclosure relates generally to apparatuses, systems and methods for affecting movement of a land vehicle. In particular, the present disclosure relates to apparatuses, systems and methods for selectively affecting the movement of a motor vehicle including, for example, deterring, restraining and/or immobilizing a motor vehicle by entangling one or more tires on the vehicle.

BACKGROUND

Conventional devices for slowing, disabling, immobilizing and/or restricting the movement of a land vehicle include barriers, tire spike strips, caltrops, snares and electrical system disabling devices. For example, conventional spike strips include spikes projecting upwardly from an elongated base structure that is stored as either a rolled up device or an accordion type device. These conventional spike strips are unfurled or unfolded and placed on a road in anticipation that an approaching target vehicle will drive over the spike strip. Successfully placing a conventional spike strip in the path of a target vehicle results in one or more tires of the target vehicle being impaled by the spike(s), thereby deflating the tire(s). This can make it difficult for the driver to maintain control of the vehicle and can result in personal injury and/or property damage.

Conventional devices may be used by first response personnel, law enforcement personnel, armed forces personnel or other security personnel. It is frequently the case that these personnel must remain in close proximity when deploying these devices. For example, a conventional method of deploying a spike strip is to have the personnel toss the spike strip in the path of an approaching target vehicle. This conventional method places the security personnel at risk insofar as the driver of the target vehicle may try to run down the security personnel or the driver may lose control of the target vehicle while attempting to maneuver around the spike strip and hit the security personnel. Further, rapidly deflating only one of the steering tires may cause a target vehicle to careen wildly and possibly strike nearby security personnel, bystanders, or structures.

Accordingly, there are a number of disadvantages of conventional devices including difficulty deploying these devices in the path of a target vehicle and/or the risk to security personnel while deploying or retracting these devices. The proximity of the security personnel to the target vehicle when the vehicle encounters these devices also may place the security personnel at risk of being struck by the vehicle. Further, these devices have limited or no ability to selectively engage a target vehicle and allow other vehicles to safely pass.

DETAILED DESCRIPTION

A. Overview

Figure 1A:
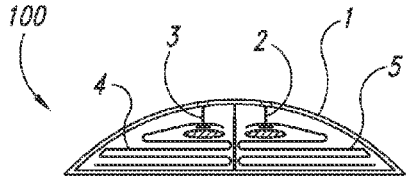
FIG. 1A is a schematic view illustrating a vehicle immobilizing device in a first arrangement according to an embodiment of the present disclosure.

Embodiments in accordance with the present disclosure are set forth in the following text to provide a thorough understanding and enabling description of a number of particular embodiments. Numerous specific details of various embodiments are described below with reference to immobilization devices for vehicles having tires engaging a paved surface, but embodiments can be used with other ground engaging features (e.g., tracks) and with other types of terrain (e.g., dirt, gravel, and other non-paved surfaces). In some instances, well-known structures or operations are not shown, or are not described in detail to avoid obscuring aspects of the inventive subject matter associated with the accompanying disclosure. For example, a wheel may generically refer to a wheel including a solid rubber or pneumatic tire mounted around its periphery. A person skilled in the art will understand, however, that the invention may have additional embodiments, or that the invention may be practiced without one or more of the specific details of the embodiments as shown and described.

Aspects of the present invention are generally directed to an apparatus for affecting movement of a vehicle that includes a rotating wheel. One aspect of embodiments is directed toward an apparatus including a housing configured to be positioned in a path of the vehicle such that the rotating wheel crosses the housing, a membrane or snare having a contracted arrangement and an extended arrangement, and a snagging member coupled to the snare. The snare is disposed in the housing in the contracted arrangement and is configured to wrap around the wheel in the extended arrangement. The snagging member is configured to snag the wheel when the snare is in the contracted arrangement.

Other aspects of the present invention are generally directed to a system for affecting movement of a vehicle that includes first and second rotating wheels. One aspect of embodiments includes a housing configured to be positioned in a path of the vehicle such that the first and second rotating wheels cross the housing, first and second snares having contracted and extended arrangements, first and second sets of snags coupled to the first and second snares, respectively, and a safe/armed mechanism configured to deploy an individual set of snags from a safe or stowed arrangement to an armed or deployed arrangement. The first snare is disposed in the housing in its contracted arrangement and is configured to wrap around the first wheel in its extended arrangement. The second snare is disposed in the housing in its contracted arrangement and is configured to wrap around the second wheel in its extended arrangement. Individual sets of snags are configured to extract an individual snare from the housing between the contracted and extended arrangements, and individual snags are generally shielded by the housing in the stowed arrangement and are exposed in the deployed arrangement.

Yet other aspects of the present invention are generally directed to a method for affecting movement of a vehicle that includes a rotating wheel. One aspect of embodiments includes positioning a housing in a path of the vehicle such that the rotating wheel crosses or traverses the housing, enclosing a snare in the housing and coupling a snagging member to the snare, exposing the snagging member with respect to the housing, engaging the snagging member with the rotating wheel, and entangling the snare around the rotating wheel so as to bring the target vehicle to a stop.

Certain embodiments according to the present disclosure include a vehicle restraint system that entangles the wheels of a selected moving vehicle to deter, restrain, or immobilize the vehicle as it travels along a path. The vehicle restraint system includes a housing that has been installed or otherwise placed in the ground or in the path of a targeted vehicle, e.g., on a roadway. In an exemplary embodiment, as the vehicle is driven over the housing, the front wheels of the vehicle become snagged and a snare is dispensed from the housing to wrap around the front wheels during rotation of the front wheels, while the back wheels of the vehicle become snagged and a second snare is dispensed from the housing that wraps around the back wheels during rotation of the back wheels. Upon entangling both the front and back wheels with the first and second snares, the target vehicle slows to a stop. This can be accomplished without incurring permanent damage to the vehicle or injury to the vehicle driver.

Certain other embodiments according to the present disclosure include the housing configured as a protuberance that extends at least in part laterally across the width of a roadway. A snare is dispensed from the housing and may include netting and/or a web-like material that is of sufficient strength to be twisted around vehicle tires to ensnare or entangle the vehicle tires. The housing may contain a first and/or second netting sub-system for engaging front and/or rear vehicle tires of an oncoming target vehicle. When the front tires of the target vehicle are driven over the housing, the netting/web-like material is dispensed from the first netting sub-system within the housing to engage with the front vehicle tires and ensnare or entangle the front tires during tire rotation. Likewise, when the rear tires of the target vehicle are driven over the housing, the netting/web-like material is dispensed from the second netting sub-system within the housing to engage with the rear vehicle tires and ensnare or entangle the rear tires during tire rotation. With both sets of tires entangled, the vehicle will slow to a stop, regardless of whether the vehicle has front-wheel drive, rear-wheel drive, or all-wheel drive. In certain embodiments, the vehicle immobilizing device may include components to ensnare or entangle either the front or rear wheels of the target vehicle depending on the vehicle wheel configuration, e.g., front, rear, or other wheel drive.

The housing may be configured as a road protuberance that slightly bulges above a road surface, e.g., a "speed bump" (also referred to as a "speed hump," "road hump" or "sleeping policeman"). Alternatively, the housing may be configured to be installed in a cut-away in a road and seated flush with the pathway. In either manner, the housing may be configured such that its capability for vehicle immobilization is concealed from the driver of an oncoming vehicle.

Certain other embodiments according to the present disclosure include a system that can be selectively armed and disarmed. When disarmed, the system is placed into a "sleep" or "deactivated" mode in which vehicles may be driven over the housing without consequence, much like a conventional speed bump. When the system is armed, however, the system will snag, for example, the tires of the next vehicle that is driven across the housing. In certain embodiments, as hereinafter described, the system can be selectively armed and disarmed remotely via wired or wireless communication from a vehicle sensor and/or an operator controlled device.

Certain other embodiments according to the present disclosure include a housing having two openings, through which the first and second netting/web-like material is dispensed, e.g., one snare per opening. The netting/web-like material may include a section in which barbs, spikes, nails, staples, adhesive patches or other types of snagging members are affixed to or integrated with the material to engage a vehicle wheel(s) that are driven across the openings in the housing. When the system is armed and a target vehicle is detected, the snagging members for the first netting/web-like material are positioned so as to be exposed, e.g., protrude outward from the upper surface of the housing, as the front vehicle wheels are being driven across a first opening in the upper housing. This causes the front wheels of the vehicle to become snagged. As the front wheels continue to rotate, the first netting/web-like material is pulled by the rotating wheel to extract the material from within the housing and become wrapped around the front rotating wheels. Likewise, the snagging members for the second netting/web-like material are positioned so as to be exposed, e.g., protrude outward from the upper surface of the housing, as the rear vehicle wheels are being driven across a second opening in the upper housing, thereby causing the rear wheels to become snagged by the spikes/barbs, causing the second netting/web-like material to be dispensed from the housing and become entangled around the rear rotating wheels.

The inventive subject matter as described in this disclosure is not limited to a system that utilizes two sets of netting/web-like material. In alternative embodiments, the vehicle immobilizing system may include netting/web-like material for engaging with only the front set of wheels, or only the rear set of wheels. In still other alternative embodiments, the netting/web-like material may be sized and configured to ensnare or entangle both the front and rear wheels on one side of the vehicle. Additionally, in embodiments in which two sets of netting/web-like material are employed, the housing may be configured such that both sets are dispensed serially from the same opening. In still other embodiments, a first netting/web-like material may be employed for the front wheels, whereas a different netting/web-like material may be employed for the rear wheels.

Figure 1B:
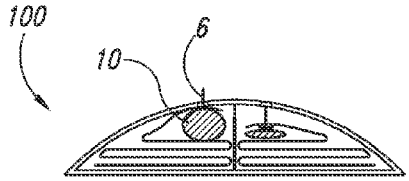
FIG. 1B is a schematic view illustrating the vehicle immobilizing device shown in FIG. 1A in a second arrangement.

B. Embodiments of Apparatuses, Systems and Methods for Selectively Affecting Movement of a Vehicle Including, for Example, Deterring, Restraining or Immobilizing the Vehicle FIGS. 1A and 1B are schematic views illustrating different arrangements of a vehicle immobilizing device 100 according to an embodiment of the present disclosure. In particular, FIG. 1A shows the device 100 in a first or stowed arrangement and FIG. 1B shows the device 100 in a second or deployed arrangement. In the stowed configuration shown in FIG. 1A, the device 100 can be embodied in the form of or housed in a speed-bump 1. Two series of snagging members, e.g., tire spikes 2 and 3, are disposed inside the speed-bump 1 in the stowed configuration. The material, size and shape of individual snagging members can be selected to penetrate into, penetrate through, latch onto and/or adhere to a wheel as a vehicle drives over the device 100, e.g., as the wheel traverses the device 100.

Coupled to the series of spikes 2 and 3 are snaring members 4 and 5, respectively, that are also disposed inside the speed-bump 1 in the stowed configuration. Individual snaring members include a snaring net, a woven membrane, a combination thereof, or another suitable member for wrapping around a wheel. Examples of materials for the snaring members can include polyester (e.g., Dacron®), polyethylene (e.g., Spectra® or Dyneema®), aramids (e.g., Technora® or Kevlar®), combinations thereof, or other materials that are suitably strong and flexible, and can be formed into fibers or a film that can be packaged inside the speed-bump 1. According to embodiments of the present disclosure, the length of individual snaring members can be at least approximately the circumference of a wheel on a vehicle that is to be immobilized. For example, for a wheel having a diameter of 33 inches, the length of the snaring members 4 and 5 can be at least approximately 90 inches. Sizes and shapes of individual snaring members can also be varied based on the anticipated size and potential speed of a vehicle that is expected to be immobilized. Individual snaring members can be packaged, e.g., accordion folded, rolled, or a combination thereof, and disposed within the speed-bump 1 so as to control the speed and withdrawal of the snaring member from the speed-bump 1.

In the second or deployed configuration of the device 100 shown in FIG. 1B, an exposed spike 6 is disposed outside of the speed-bump 1. The spike 6, which is one of the series of spikes 3, can be deployed pyrotechnically, mechanically (e.g., resiliently biased by a spring), electrically, pneumatically, or by any other suitable technique using an actuator 10. In the embodiment shown in FIG. 1B, an inflatable bladder 10 disposed inside the speed-bump 1 can be used to pneumatically deploy the spike 6. According to other embodiments, spikes can be deployed by various motions including translation, pivoting, combinations thereof, or any other suitable form of movement.

Figure 2:
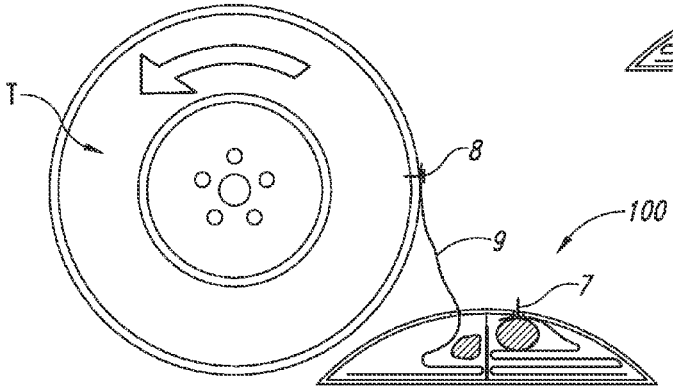
FIG. 2 is a schematic illustration of a method according to an embodiment of the present disclosure for immobilizing a vehicle using the device shown in FIGS. 1A and 1B.

Referring additionally to FIG. 2, which illustrates a method according to an embodiment of the present disclosure for immobilizing a vehicle using the device 100, a tire T rolls over a deployed spike 8, which penetrates into and/or becomes latched onto the tire T. In a third or extended arrangement as shown in FIG. 2, by nature of having the spike 8 lodged in the tire, snaring member 9 is unfolded, un-spooled, or is otherwise drawn out from the stowed arrangement in which it was previously packaged.

Figure 3A:
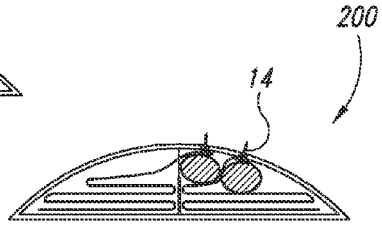
FIG. 3A is a schematic view illustrating a vehicle immobilizing device according to another embodiment of the present disclosure.
Figure 3B:
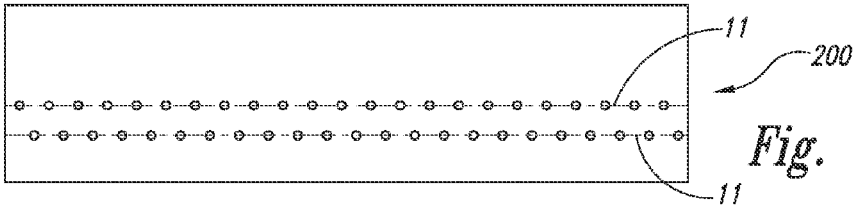
FIG. 3B is a plan view showing the vehicle immobilizing device of FIG. 3A.

FIGS. 3A and 3B are schematic views illustrating a vehicle immobilizing device 200 according to another embodiment of the present disclosure. As compared to the embodiment illustrated in FIGS. 1A and 1B, both series of spikes are disposed on the leading surface of the speed-bump 1. That is to say, the deployed spikes 14 are disposed inside the speed-bump 1 so as to subsequently project from the initial surface that is contacted and climbed by a wheel (not shown) rolling over the device 200. In the embodiment shown in FIG. 3B, the spikes 14 may also be deployed through frangible seams 11 on the surface of the speed-bump 1.

Figure 4A:
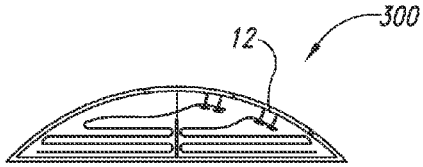
FIG. 4A is a schematic view illustrating a vehicle immobilizing device in a first arrangement according to yet another embodiment of the present disclosure.
Figure 4B:
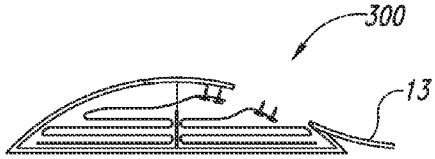
FIG. 4B is a schematic view illustrating the vehicle immobilizing device shown in FIG. 3A in a second arrangement.
Figure 4C:
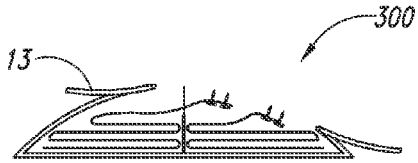
FIG. 4C is a schematic view illustrating the vehicle immobilizing device shown in FIG. 3A in a third arrangement.

FIGS. 4A to 4C illustrate a vehicle immobilizing device 300 according to yet another embodiment of the present disclosure. In the stowed arrangement shown in FIG. 4A, sets of spikes 12 are disposed inside the speed-bump 1. As with other embodiments in accordance with the present disclosure, an individual spike set 12 can include plural barbs. For example, two barbs for each spike set 12 are illustrated in FIGS. 4A to 4C. In a partially deployed arrangement shown in FIG. 4B, a first cover 13 can be actuated to expose a first set of the spikes 12. As with other embodiments according to the present disclosure, individual covers 13 can be actuated pyrotechnically, mechanically, electrically, pneumatically, or by any other suitable technique. In the deployed arrangement shown in FIG. 4C, a second cover 13 can be actuated to expose another set of the spikes 12. Accordingly, sequential exposure of two spike sets 12 can be achieved by a two-stage opening of covers 13.

Figure 5:
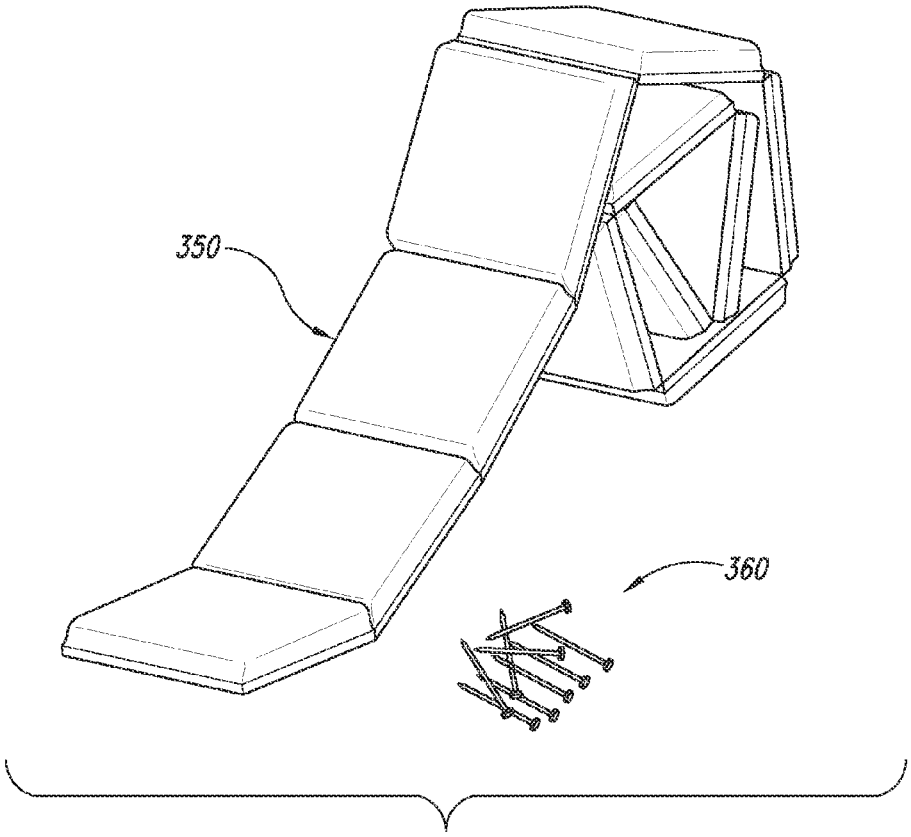
FIG. 5 is a perspective view of a vehicle immobilizing device according to a further embodiment of the present disclosure.

FIG. 5 is a perspective view of a vehicle immobilizing device 350 according to a further embodiment of the present disclosure. The immobilizing device 350 is shown coiled so as to facilitate movement, installation, removal and relocation. Fasteners 360 can be used to securely position the device 350 to a road surface, e.g., asphalt, concrete, or another suitable firm surface. In other embodiments, the device 350 can be disposed within a housing (not shown). For example, the device 350 can be disposed within a recyclable housing shaped like a speed bump that can have a frangible seam through which the device 350 operates.

Figure 6A:
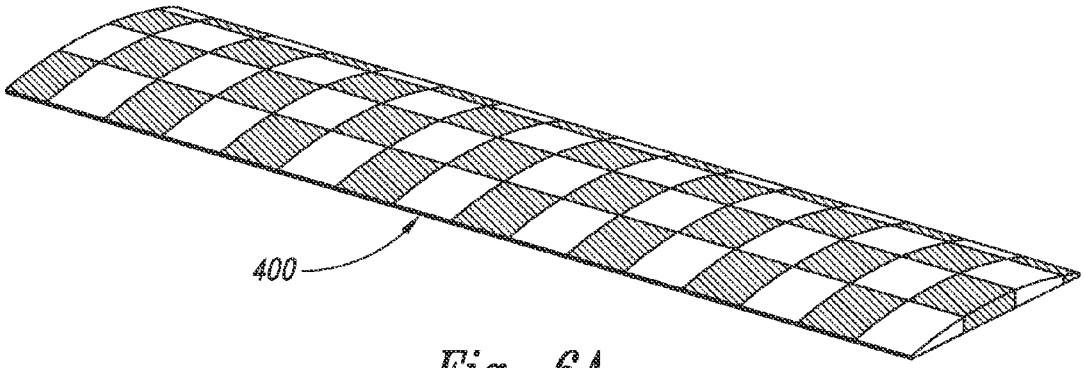
FIG. 6A is a first perspective view of a vehicle immobilizing device according to a yet further embodiment of the present disclosure.
Figure 6B:
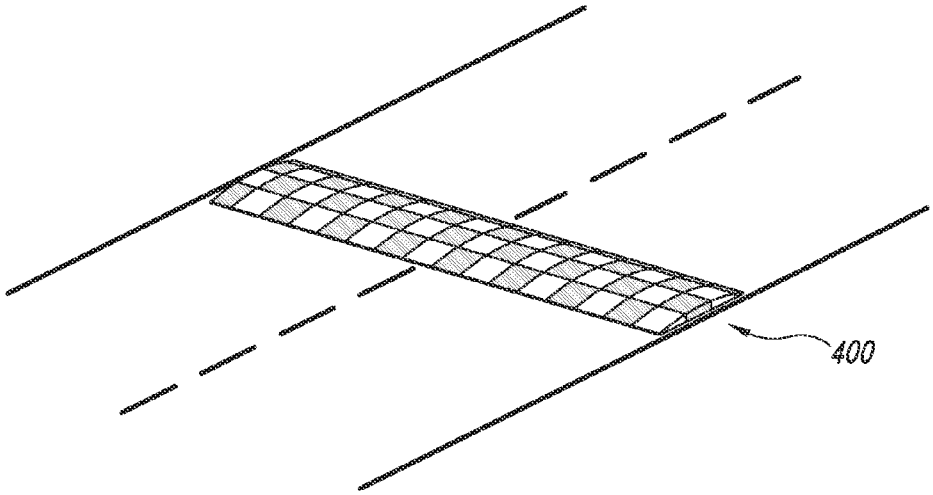
FIG. 6B is a second perspective view of the vehicle immobilizing device shown in FIG. 6A.
Figure 6C:
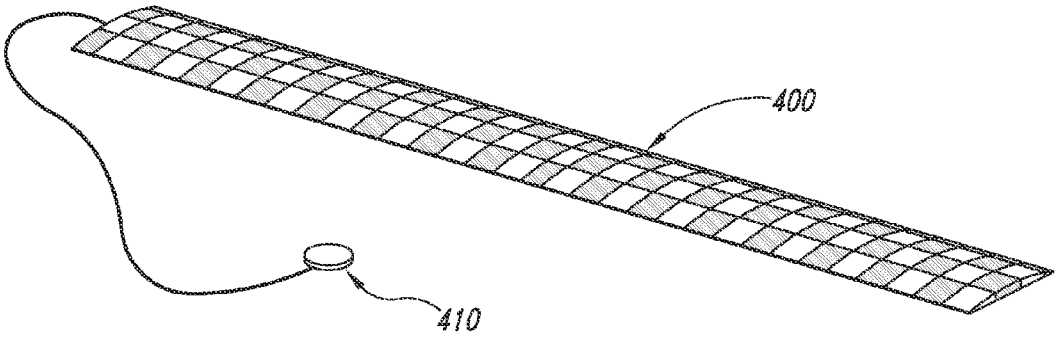
FIG. 6C is a third perspective view of the vehicle immobilizing device shown in FIG. 6A.

FIGS. 6A to 6C are perspective views of a vehicle immobilizing device 400 in a stowed arrangement according to a further embodiment of the present disclosure. In particular, FIGS. 6B and 6C show the device 400 arranged in suitable environments. In FIG. 6C, a sensor 410 for deploying the device 400 is shown disposed in front of the deploying device 400.

The sensor 410 can be used to determine the presence of a vehicle (not shown). For example, the sensor 410 can determine the presence of one or more characteristics or properties of a vehicle including mass, heat, sound, electromagnetic field, vibration, motion, or another suitable property. Upon determining the presence of a vehicle, the sensor 410 can reconfigure one of the vehicle immobilizing devices 100, 200, 300, 350 or 400 to the deployed arrangement, e.g., energizing the actuator(s) 10 to deploy at least one set of spikes 6 from the device 100.

According to other embodiments of the present disclosure, individual sensors can be disposed on or inside the speed-bump 1. For example, a pressure sensor can be disposed at the leading edge of the speed-bump 1 and can include an inflated bladder (not shown) that, when crushed by the vehicle (not shown), sends a pneumatic signal to a pneumatic actuator. Alternatively, a proximity sensor can send an electrical signal to a pyrotechnical actuator, or another suitable sensor can signal a corresponding suitable actuator.

Figure 7A:
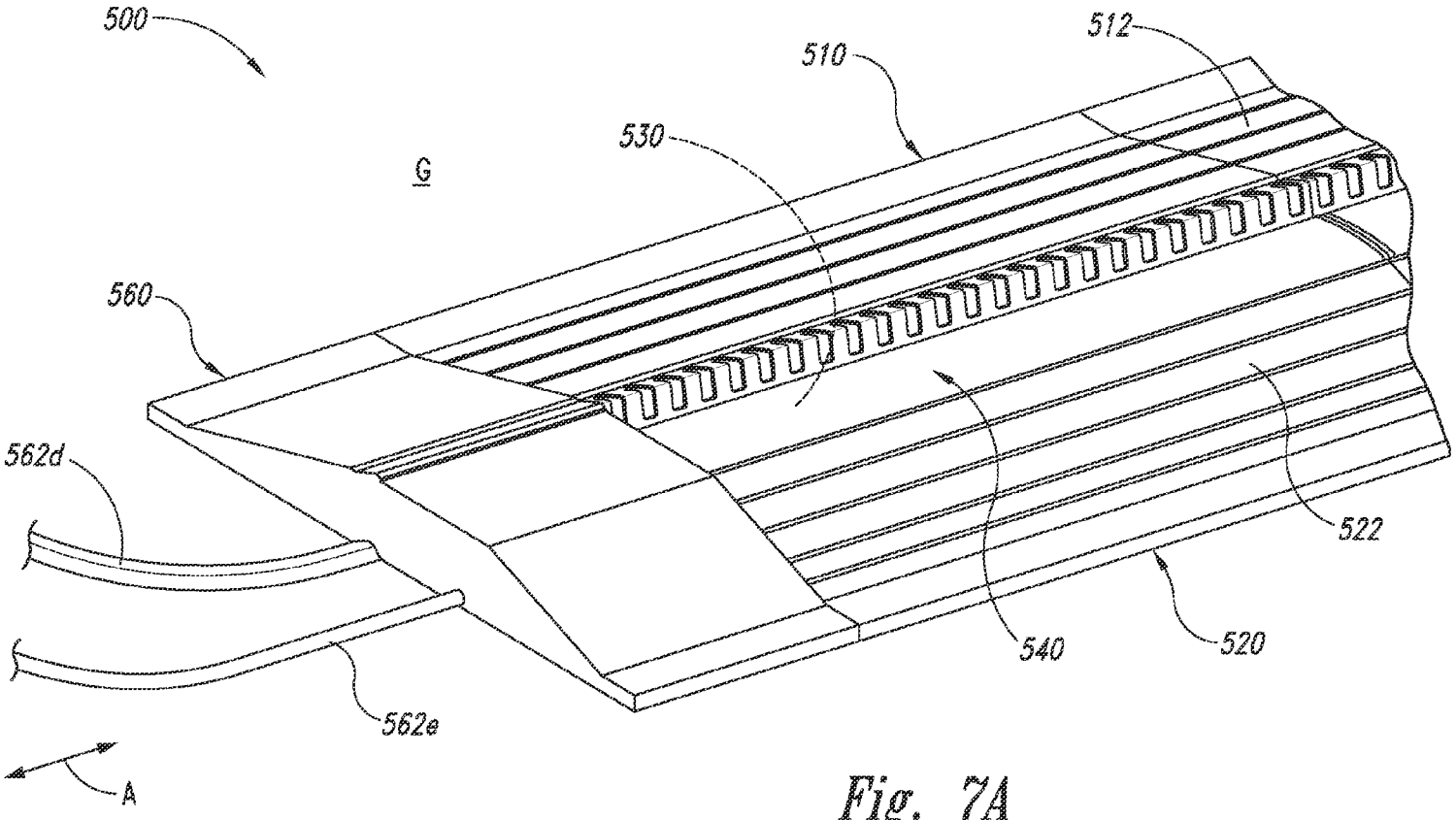
FIG. 7A is a partial perspective view illustrating a vehicle immobilizing device in a first arrangement according to still another embodiment of the present disclosure.

FIG. 7A is a partial perspective view illustrating a vehicle immobilizing device 500 in a first or stowed arrangement according to still another embodiment of the present disclosure. The immobilizing device 500 includes a leading ramp 510 and a trailing ramp 520. The leading ramp 510 is initially engaged by a tire of an approaching target vehicle (not shown in FIG. 7A) and the trailing ramp 520 can provide a transition back down to a wheel engaging ground surface G, e.g., a paved road. The leading and trailing ramps 510 and 520 extend along a longitudinal axis A and can have the same or different lengths, the same or different heights, and/or the same or different angles of inclination. Moreover, the leading and trailing ramps 510 and 520 can be coupled as an integral unit or separately positioned on either side of a cavity 530 between the leading and trailing ramps 510 and 520. Certain embodiments of the leading and trailing ramps 510 and 520 according to the present disclosure can have ramp surfaces 512 and 522, respectively, which include a flat surface, a concave surface, a convex surface, or combinations thereof. Certain other embodiments of the leading and trailing ramps 510 and 520 according to the present disclosure can have graduated surfaces, e.g., steps, that transition between the wheel engaging ground surface G and the cavity 530.

Figure 7B:
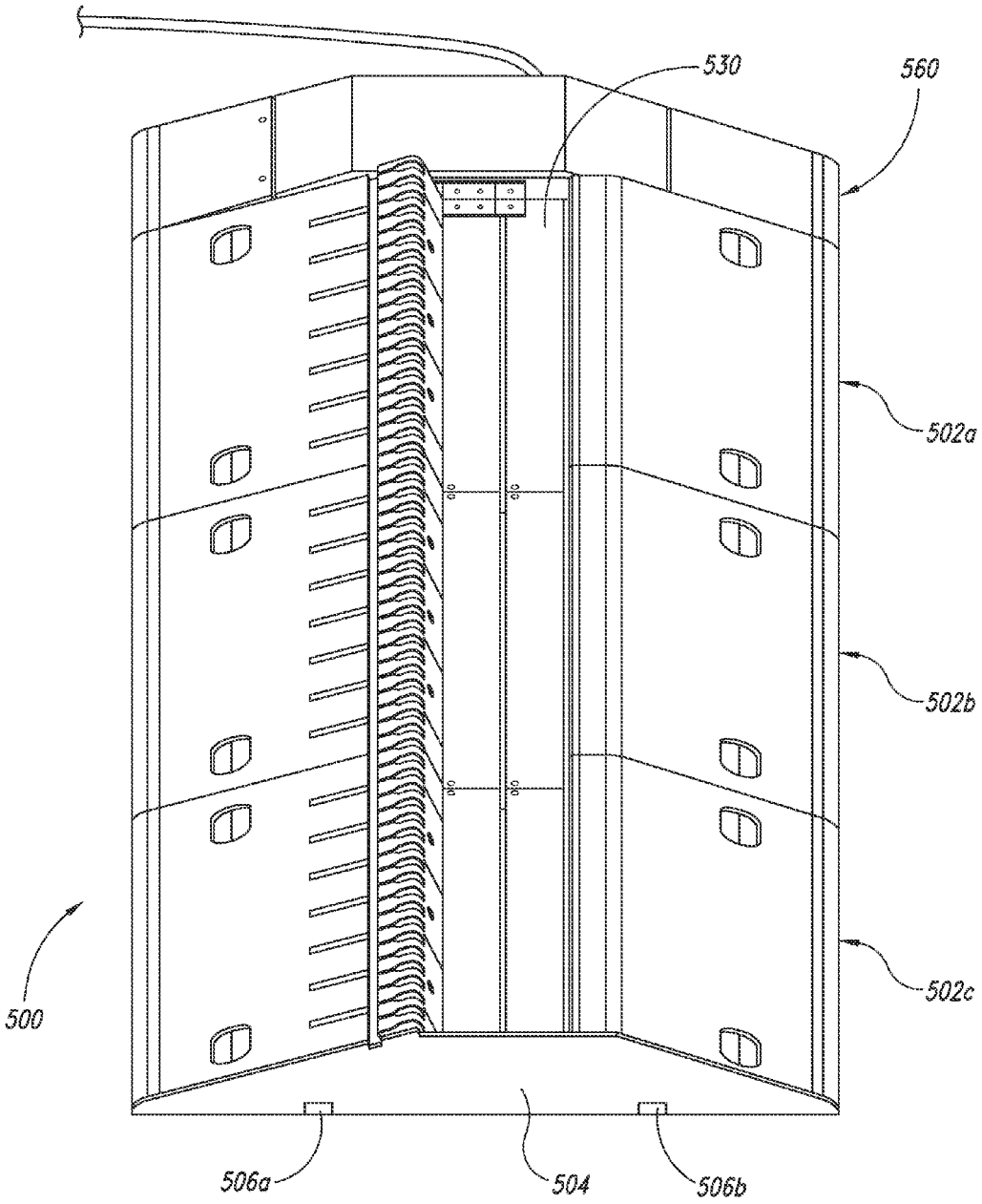
FIGS. 7B and 7C are perspective views from opposite ends of the vehicle immobilizing device of FIG. 7A without a deployment module.

Referring again to FIG. 7A, the immobilizing device 500 may also include a control segment 560. The control segment 560 shown in FIG. 7A is coupled at one end of the immobilizing device 500. Certain other embodiments of the control segments 560 according to the present disclosure may be located at an intermediate position along the immobilizing device 500, e.g., between segments of the leading and trailing ramps 510 and 520. For example, housing segments 502 of the immobilizing device 500 can be combined, e.g., linked or positioned end-to-end. These housing segments 502 (FIG. 7B shows, for example, three individual housing segments 502*a-c* and a control segment 560) can have the same or different lengths. Accordingly, the length of the immobilizing device 500 can be adjusted by selecting the number and length of the housing segments 502 to be combined. An end segment 504 may be coupled at a longitudinal end of the immobilizing device 500 that is opposite the control segment 560. For example, the end segment 504 may include an end plate as shown in FIG. 7B or may have an exterior size and shape that is generally similar to the control segment 560.

Figure 7C:
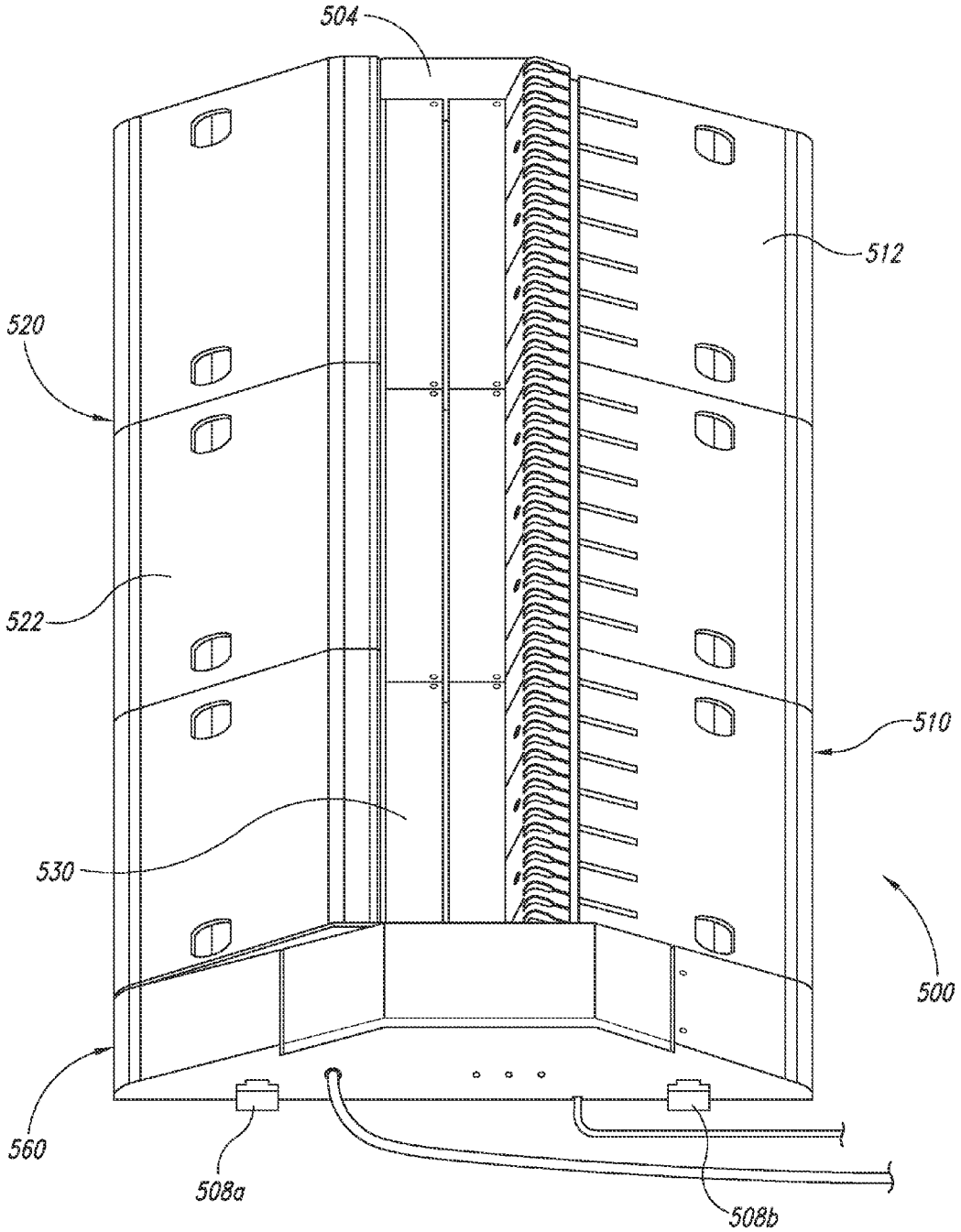

FIGS. 7B and 7C show a cavity 530 that may be incorporated into the housing between the leading and trailing ramps 510 and 520. The cavity 530 can be sized and shaped to contain a deployment module (not shown in FIGS. 7B and 7C). Certain embodiments of the immobilizing device 500 may include only one of the ramps 510 and 520, e.g., with the cavity 530 may be disposed adjacent thereto. Certain other embodiments of the immobilizing device 500 may omit both ramps 510 and 520, e.g., the cavity 530 can be partially or completely formed in the wheel engaging ground surface G, e.g., as a trench.

FIGS. 7B and 7C also show a coupling system including slots 506 (two slots 506*a* and 506*b* are shown in FIG. 7B) and tabs 508 (two tabs 508*a* and 508*b* are shown in FIG. 7C) for combining housing segments 502, end segments 504, and/or control segments 560. In particular, individual tabs 508 may interlock with corresponding slots 506 to link together a series of segments. Other embodiments may use different coupling systems that enable a series of segments to be combined in different sequences of the segments and/or to form immobilizing devices 500 having different longitudinal lengths.

Figure 7D:
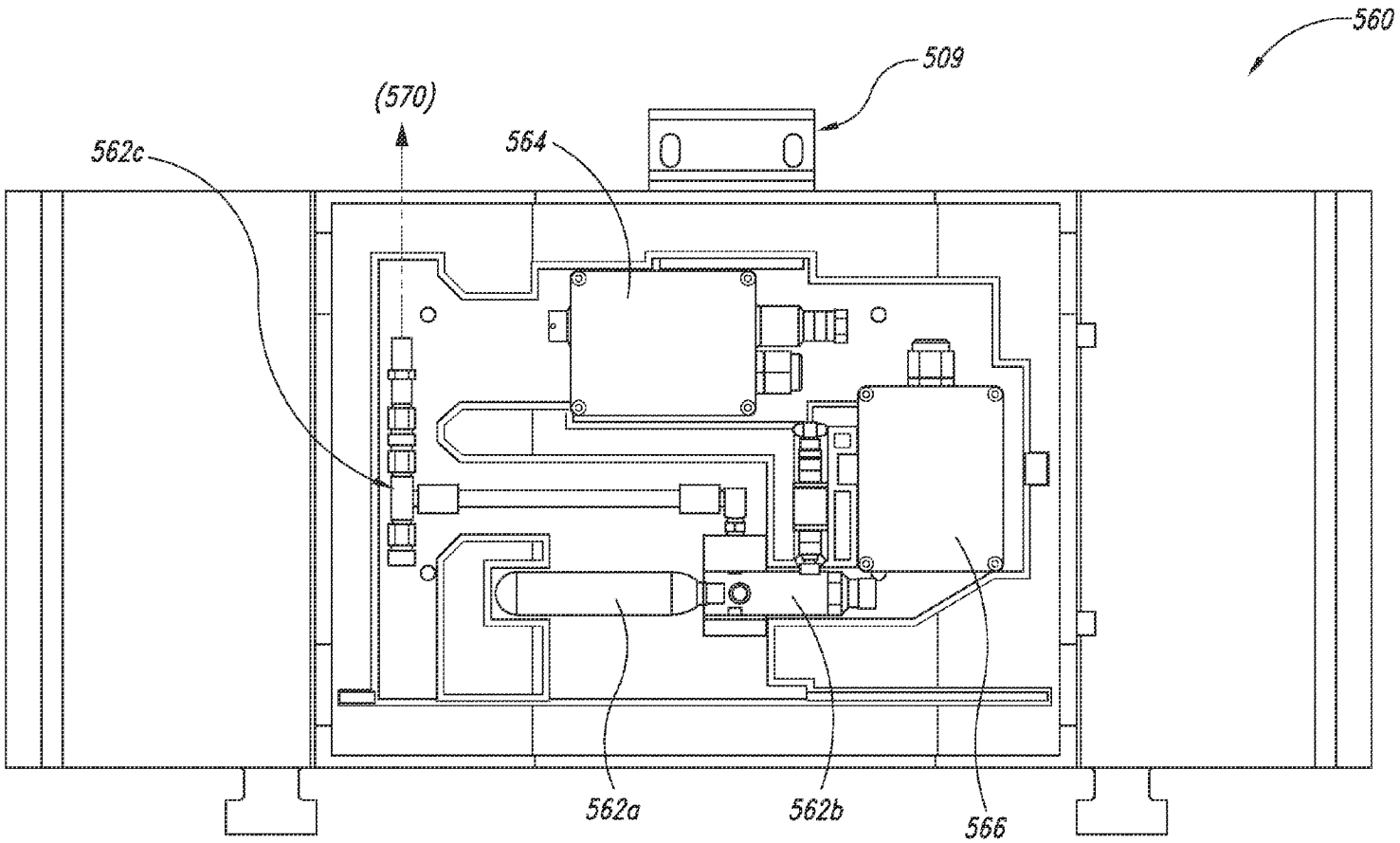
FIG. 7D is a detail view illustrating components of a control segment of the vehicle immobilizing device of FIG. 7A.

FIG. 7D shows the control segment 560 with a protective cover removed. The control segment 560 can include, for example, an actuator energy source 562*a*, a controller 564, and a power supply 566, e.g., a battery. The actuator energy source 562*a* can include a gas generator, a pressurized accumulator tank, or any other energy source for energizing the actuator mechanism 570. An embodiment according to the present disclosure as shown in FIG. 7D shows a tank 562*a* coupled to a control manifold 562*b* for controlling the release of pressure from the tank 562*a*. Plumbing 562*c* may be used to provide a fluid flow path between the control manifold 562*b* and the actuator mechanism 570. The controller 564 can include, for example, one or more electric circuits for coupling a switch for arming and/or disarming the system, system monitors, the vehicle detector 410, the actuator energy source 562, and/or the power supply 566. The control device 564 controls energizing and de-energizing the actuator mechanism 570 for deploying the spikes 6. Other embodiments of the control segment 560 may use mechanical, pneumatic, hydraulic or other analogs to the electrical system described above. The control segment 560 may also include storage space for system accessories, e.g., a remote handheld control device, replacement parts, and/or tools for assembling or re-setting the immobilizing device 500.

The embodiment of the immobilizing device 500 shown in FIG. 7A illustrates two cables 562*d* and 562*e* extending from the control segment 560. The cable 562*d* may couple the vehicle detector 410 (FIG. 6C) to the controller 564 and the cable 562*b* may coupled a remote handheld control device 590 to the controller 564. In addition to or in lieu of the remote handheld device 590 being coupled to the controller 564 via the cable 562*e*, a wireless remote device (not shown) can communicate with the controller 564 via a radio frequency signal, an infrared signal, or another type of wireless signal.

Figure 7E:
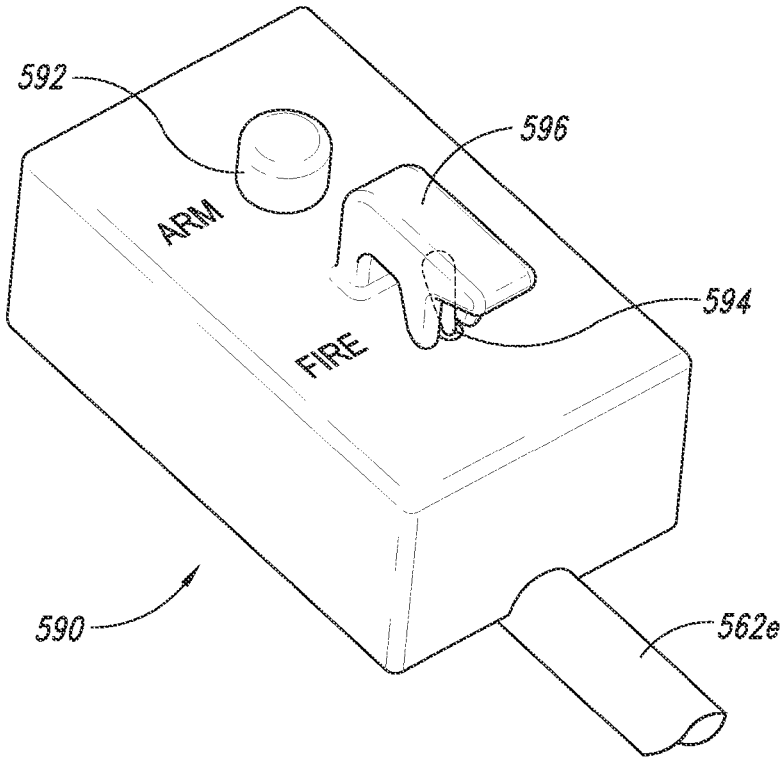
FIG. 7E is a detail view illustrating a remote handheld control device of the vehicle immobilizing device of FIG. 7A.

FIG. 7E shows an embodiment according to the present disclosure of the remote handheld control device 590 including an arm switch 592 and a fire switch 594. The arm switch 592 may be used for turning the immobilizing device 500 "ON" (e.g., enabling the snagging aspect of the immobilizing device 500) and/or "OFF" (e.g., such that the immobilizing device 500 functions as a conventional speed bump). The fire switch 594 may be used for deploying the spikes 6 from the stowed arrangement manually, e.g., rather than deploying in response to a signal from the vehicle detector 410. The fire switch 594 may also be used to disarm the immobilizing device 500, e.g., to stow the spikes 6 from the deployed arrangement. The FIRE switch 594 may be disposed under a protective cover 596 to avoid inadvertent actuation. The remote handheld control device 590 may also include additional controls and/or a display for showing the status of various system parameters, e.g., accumulator tank pressure, battery voltage, etc.

Figure 8:
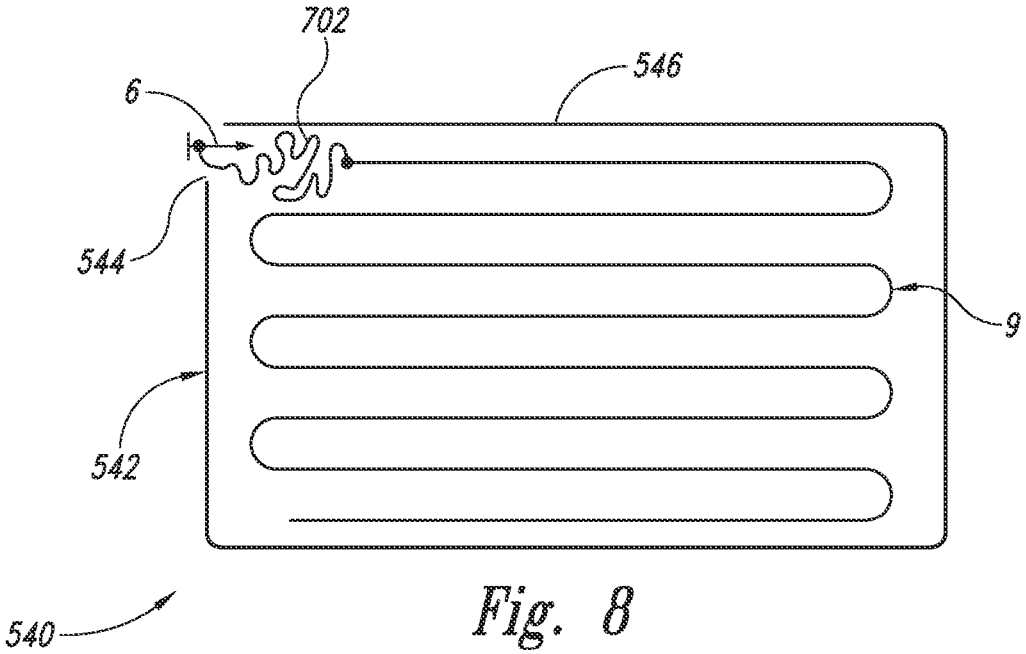
FIG. 8 is a schematic cross-section view illustrating an embodiment according to the present disclosure of a deployment module for a vehicle immobilizing device.

FIG. 8 is a schematic cross-section view of an embodiment according to the present disclosure of the deployment module 540. The deployment module 540 can include a case 542 for packaging a snaring member 9, a plurality of spikes 6, and a plurality of tethers 702 for coupling the spikes 6 to the snaring member 9. The case 542 can be formed from a relatively rigid material, e.g., metal, a relatively flexible material, e.g., canvas, or a combination of materials for covering the cavity 530 and providing a dust and debris shield for the snaring member 9. An embodiment according to the present disclosure may include a canvas case 542 that allows the deployment module 540 to be folded if desired. The case 542 can include at least one opening 544 and at least one covering 546. See also FIG. 5, for example. The opening 544 allows the case 542 to be accessed for extracting the spikes 6 and/or tethers 702 when the deployment module 540 is loaded in the cavity 530. In the extended arrangement, the snaring member 9 is pulled through the opening 544 by the snaring member 9 and the tethers 702.

FIG. 8 shows the snaring member 9 in its contracted arrangement packaged in the case 542. In particular, the snaring member 9 is shown folded over itself in an accordion style fold. Certain embodiments of the snaring member 9 according to the present disclosure may be additionally or alternatively rolled or folded according to different styles. Examples of different styles of folds include parallel folds, gate folds, map folds, and/or poster folds. Packaging the snaring member 9 in the case 542 may enable the snaring member 9 to be handled, e.g., shipped or loaded, without causing an appreciable detrimental effect on extending the snaring member 9 from the immobilizing device 500.

Figure 9A:
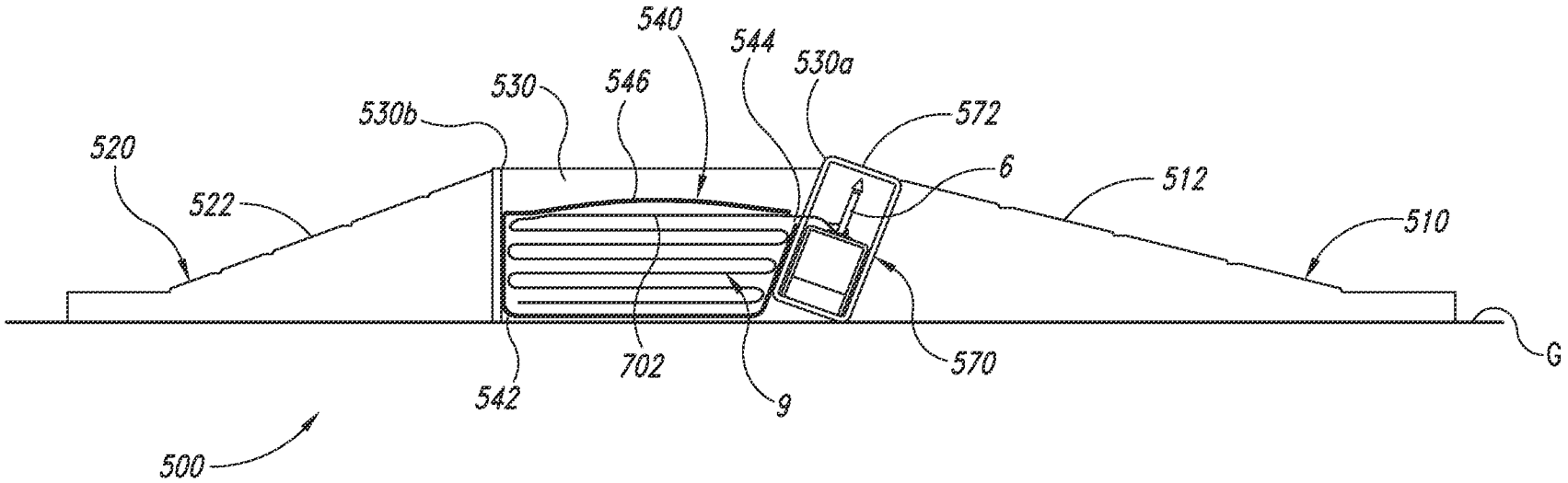
FIG. 9A is a schematic cross-section illustrating the deployment module of FIG. 8 loaded into the vehicle immobilizing device of FIGS. 7A-7D.

FIG. 9A is a schematic cross-section view of an embodiment according to the present disclosure illustrating the deployment module 540 loaded into the cavity 530 of the immobilizing device 500. The leading ramp surface 512 of the leading ramp 510 leads up to the actuator mechanism 570 at one side of the cavity 530. The actuator mechanism 570 may include a top surface 572 that has an angle of inclination that may be less than, similar to, or greater than the inclination angle of the leading ramp surface 512. Certain embodiments of the actuator mechanism 570 according to the present disclosure can include a top surface 572 having an angle of inclination in a range of 10-30 degrees relative to the wheel engaging ground surface G. FIG. 9A shows the top surface 572 having an angle of inclination that is approximately 20 degrees. The actuator mechanism 570 may alternatively be disposed at the opposite side of the cavity, e.g., the trailing ramp surface 522 of the trailing ramp 520 may trail down from the actuator mechanism (not shown), or there may individual actuator mechanisms (not shown) disposed at both sides of the cavity 530.

FIG. 9A also shows that the case 542 may be sized and shaped to conform to one or more of the bottom and sides of the cavity 530. The case 542 may extend upward from the bottom of the cavity 530 to a vertical position commensurate with a leading edge 530*a* and/or a trailing edge 530*b* of the cavity 530. Alternatively, the opening 544 and/or the covering 546 of the case 542 may positioned below the leading and/or trailing edges 530*a*,530*b*. For example, as shown in FIG. 9A, the vertical position in the cavity 530 of the opening 544 and the covering 546 may generally correspond to a vertical position of the spikes 6 in the stowed arrangement. In the embodiment shown in FIG. 9A, lateral spacing between the leading and trailing edges 530*a*,530*b*, may be selected such that the wheel T straddles the cavity 530 so as to prevent or avoid contact between the wheel T and the covering 546 of the case 542. Accordingly, the wheel T does not impact the deployment module 540 in the course of traversing the immobilizing device 500.

Figure 9B:
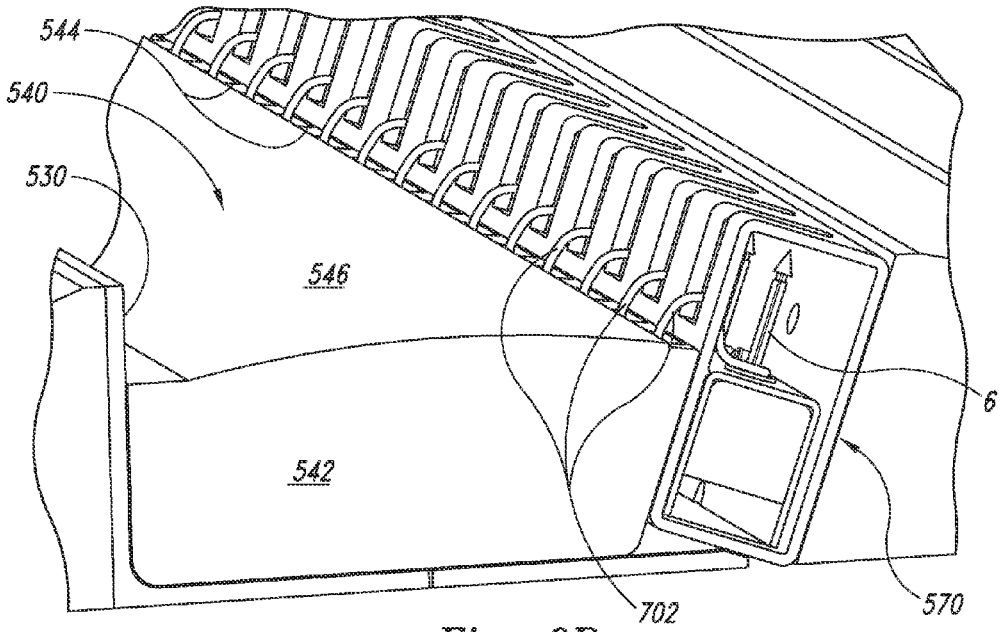
FIGS. 9B and 9C are detail views showing the deployment module of FIG. 8A in stowed and deployed arrangements.

FIG. 9B is a detail view of the immobilizing device 500 shown in FIG. 9A illustrating the stowed arrangement. With the deployment module 540 loaded in the cavity 530, individual spikes 6 may be extracted from the case 542 and fitted to the actuator mechanism 570 such that the tether 702 connecting the spike 6 to the snaring member inside the deployment module 540 extends through the opening 544. Individual tethers 702 may have sufficient length for extracting the spikes 6 without disturbing the contracted arrangement of the snaring member inside the deployment module 540.

Figure 9C:
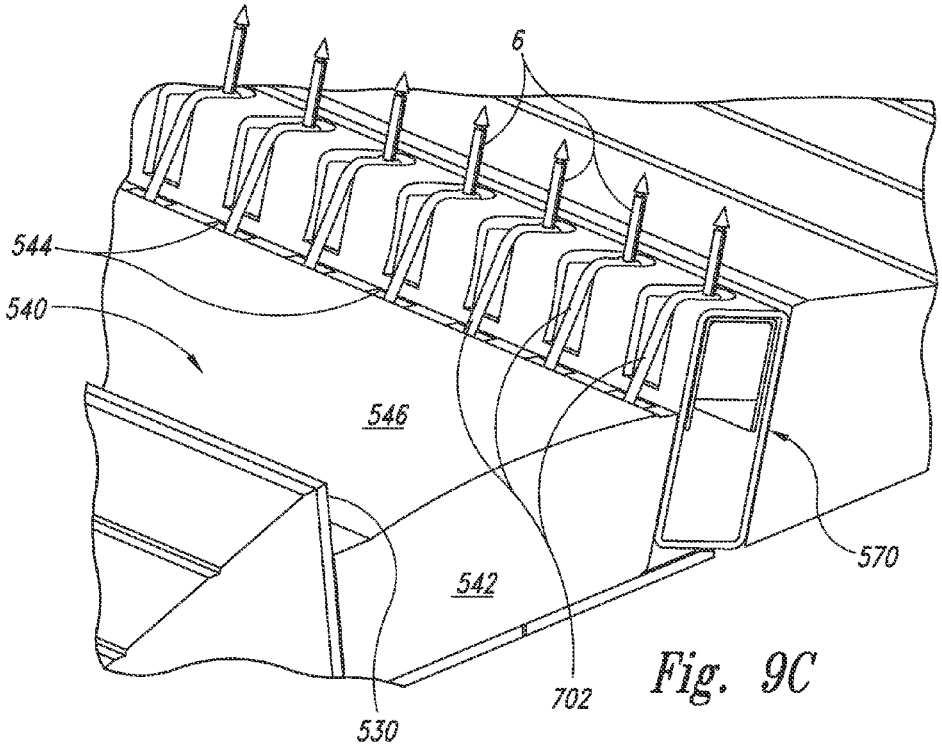

FIG. 9C is a detail view of the immobilizing device 500 shown in FIG. 9A illustrating the deployed arrangement. When the spikes 6 are deployed by the actuator mechanism 570, the tethers 702 may be further extended through the opening 544. The length of the individual tethers 702 may still be sufficient to avoid disturbing the contracted arrangement of the snaring member inside the deployment module 540.

Figure 10A:
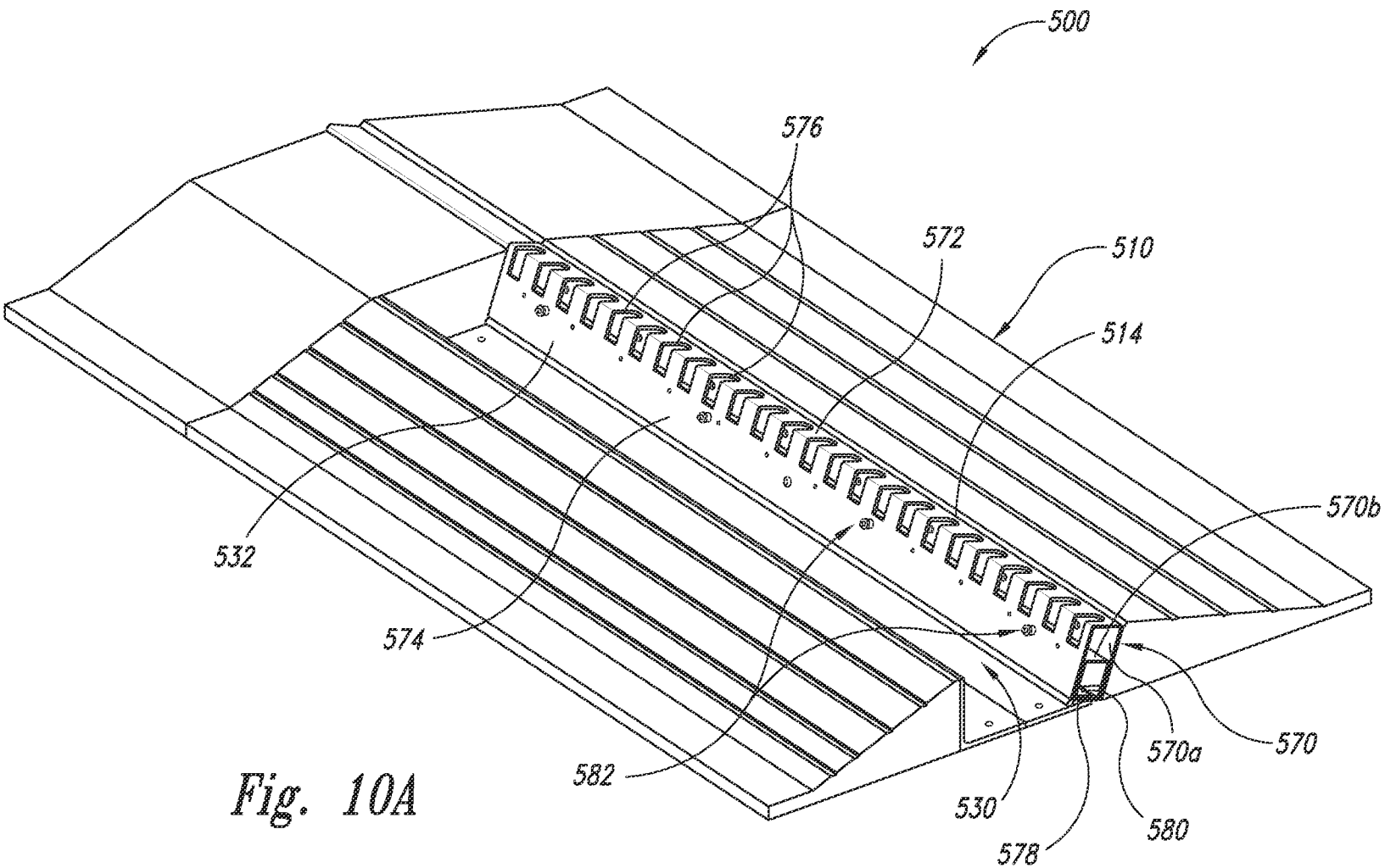
FIGS. 10A-10E are perspective views illustrating different arrangements of the vehicle immobilizing device shown FIGS. 7A-7D with the deployment module removed.

FIGS. 10A-10E are perspective views illustrating aspects of different arrangements of the vehicle immobilizing device 500 with the deployment module 540 removed. FIG. 10A shows a portion of the vehicle immobilizing device 500 in the stowed arrangement. The actuator mechanism 570 may be located between at trailing edge 514 of the leading ramp 510 and at a side 532 of the cavity 530. As shown in FIG. 10A, the side 532 of the cavity may be provided by a side surface 574 of the actuator mechanism 570. The actuator mechanism 570 can include a first rectangular member 570*a* and a second rectangular member 570*b* positioned generally inside the first rectangular member 570*a*. The first rectangular member 570*a* includes the top surface 572, the side surface 574, and a plurality of slots 576 that are formed in the top and side surfaces 572 and 574. Certain other embodiments of the actuator mechanism 570 according to the present disclosure can include members 570*a* and/or 570*b* that have cross-section shapes other than a rectangle, e.g., U-shaped or L-shaped.

In the stowed arrangement, e.g., as shown in FIG. 9B, the second rectangular member 570*b* is relatively distal from the top surface 572 and relatively proximal to a bottom surface 578 of the first rectangular member 570*a*. An actuator 580 is positioned between the bottom surface 578 and the second rectangular member 570*b*. When activated, the actuator 580 moves the second rectangular member 570*b* toward the top surface 572. When the second rectangular member 570*b* is at or near the top surface 572, at least one locking mechanism such as a spring retainer 582 locks the second rectangular member 570*b* with respect to the first rectangular member 570*a*. Accordingly, the actuator 580 moves the second rectangular member 570*b* but is not required to maintain second rectangular member 570*b* proximate to the top surface 572. Each retainer 582 can include a spring biased pin that is nominally held out of the movement path of the second rectangular member 570*b*, e.g., the second rectangular member 570*b* may block the spring biased pin from projecting into the first rectangular member 570*a*. At such time as the spring biased pin is no longer held out of the movement path of the second rectangular member 570*b*, e.g., the second rectangular member 570*b* may no longer block the spring biased pin from projecting into the first rectangular member 570*a*, the spring biased pin may project into the first rectangular member 570*a* to lock the second rectangular member 570*b* at or near the top surface 572.

Figure 10B:
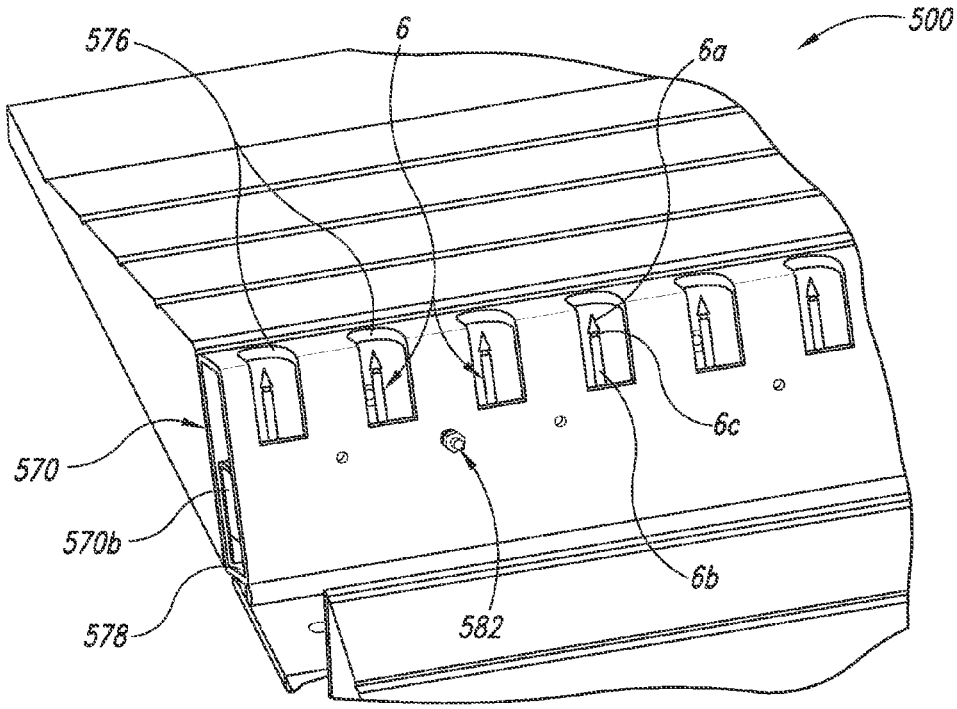

FIG. 10B illustrates details of the actuator mechanism 570 shown in FIG. 10A and of the spikes 6 in the stowed arrangement of the immobilizing device 500. FIG. 10B particularly shows individual slots 576 that are aligned with each spike 6, the actuator mechanism 570 in its un-actuated configuration, the second rectangular member 570*b* proximate to the bottom surface 578, and a retainer 582 in its unlocked configuration. FIG. 10B also particularly shows individual spikes 6 including a tip 6*a* and a body 6*b*. The tip 6*a* may include a relatively hard material, e.g., 17-4 stainless steel, which is suitable for penetrating the wheels of a target vehicle. The tip 6*a* may be coupled to the body 6*b* by an interference fit, by a weld, or another suitable coupling. The body 6*b* may include a shaft that receives a stub projection from the base of the tip 6*a* or that inserts into a hole in the base of the tip 6*a*. Each spike 6 may also include a relatively constricted portion 6*c* with respect to both the tip 6*a* and the body 6*b*.

Figure 10C:
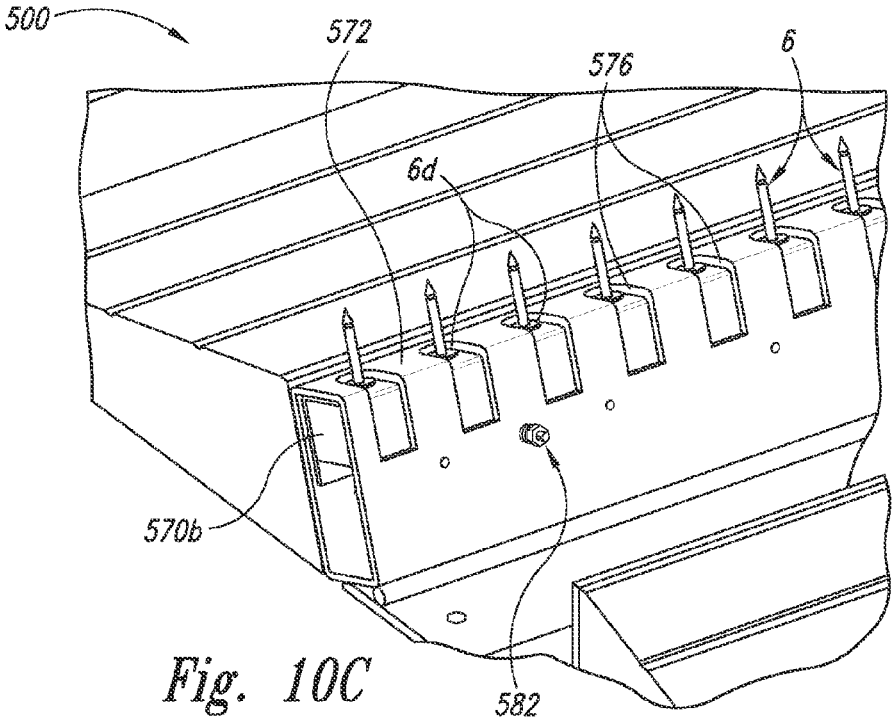

FIG. 10C shows a portion of the vehicle immobilizing device 500 in a partially deployed or "armed" configuration. In particular, FIG. 12 shows individual spikes 6 projecting through the slots 576, the actuator mechanism 570 in its actuated configuration, the second rectangular member 570*b* proximate to the top surface 572, and a retainer 582 in its locked configuration. FIG. 10C also shows that individual spikes 6 include a base 6*d* that is larger than the body 6*b* but still capable of passing through the slots 576. The base 6*d* may include a relatively flexible material, e.g., 304 stainless steel, which is suitable for allowing tilting of the body 6*b* as the moving wheels of a target vehicle engage the spikes 6.

Figure 10D:
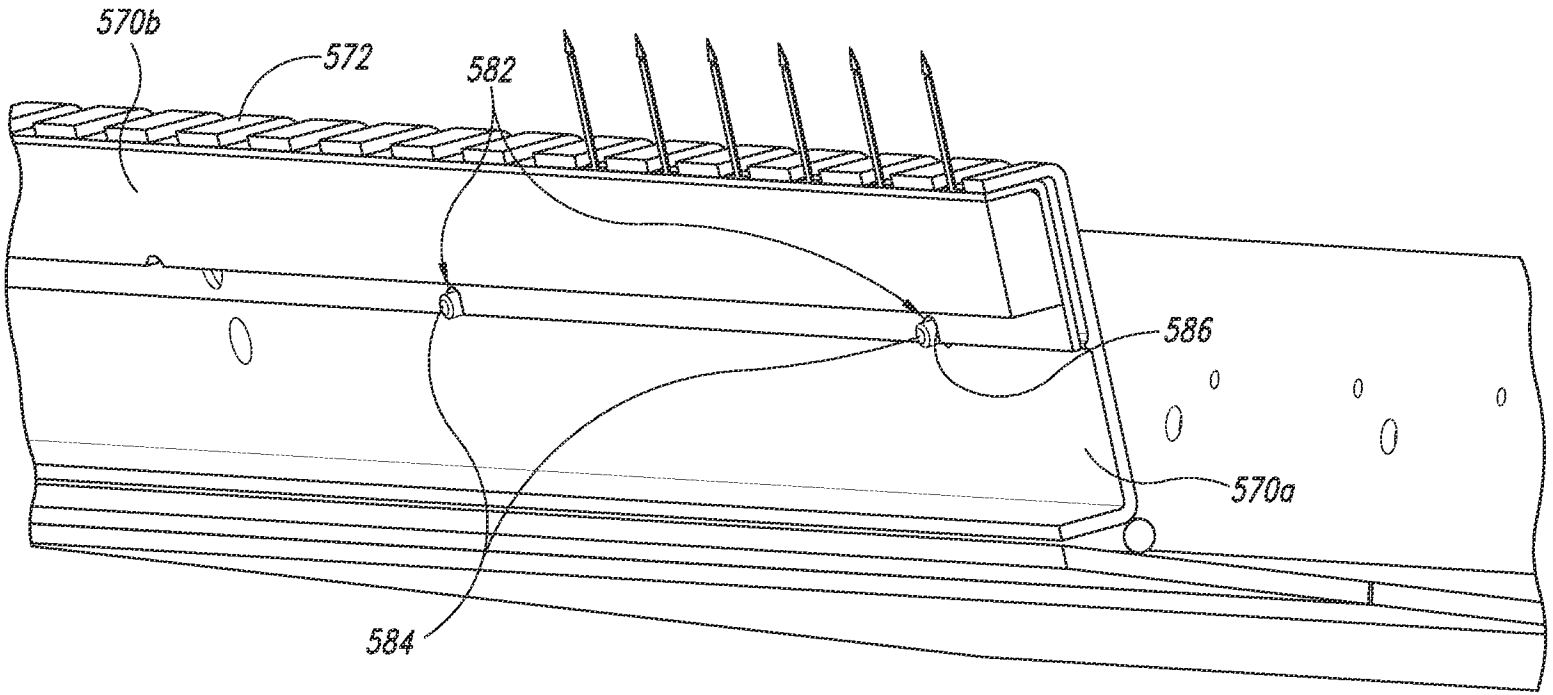

FIG. 10D shows the retainers 582 locked in the partially deployed configuration of the vehicle immobilizing device 500. Specifically, spring biased pins 584 are shown projecting into the interior of the first rectangular member 570*a* and engaging recesses 586 on the second rectangular member 570*b*. Accordingly, the spring biased pins 584 block movement of the second rectangular member 570*b* back toward the bottom surface 578 after the second rectangular member 570*b* has been moved by the actuator mechanism 570 toward the top surface 572. Certain embodiments of the immobilizing device 500 according to the present disclosure may not include the recesses 586 on the second rectangular member 570*b* and/or the recesses 586 may include holes, slots or other formations that penetrate the second rectangular member 570*b*. Further, positive locking devices other than spring biased pins may be used to prevent movement of the second rectangular member 570*b* back toward the bottom surface 578 after the second rectangular member 570*b* has been moved by the actuator mechanism 570 toward the top surface 572.

Figure 10E:
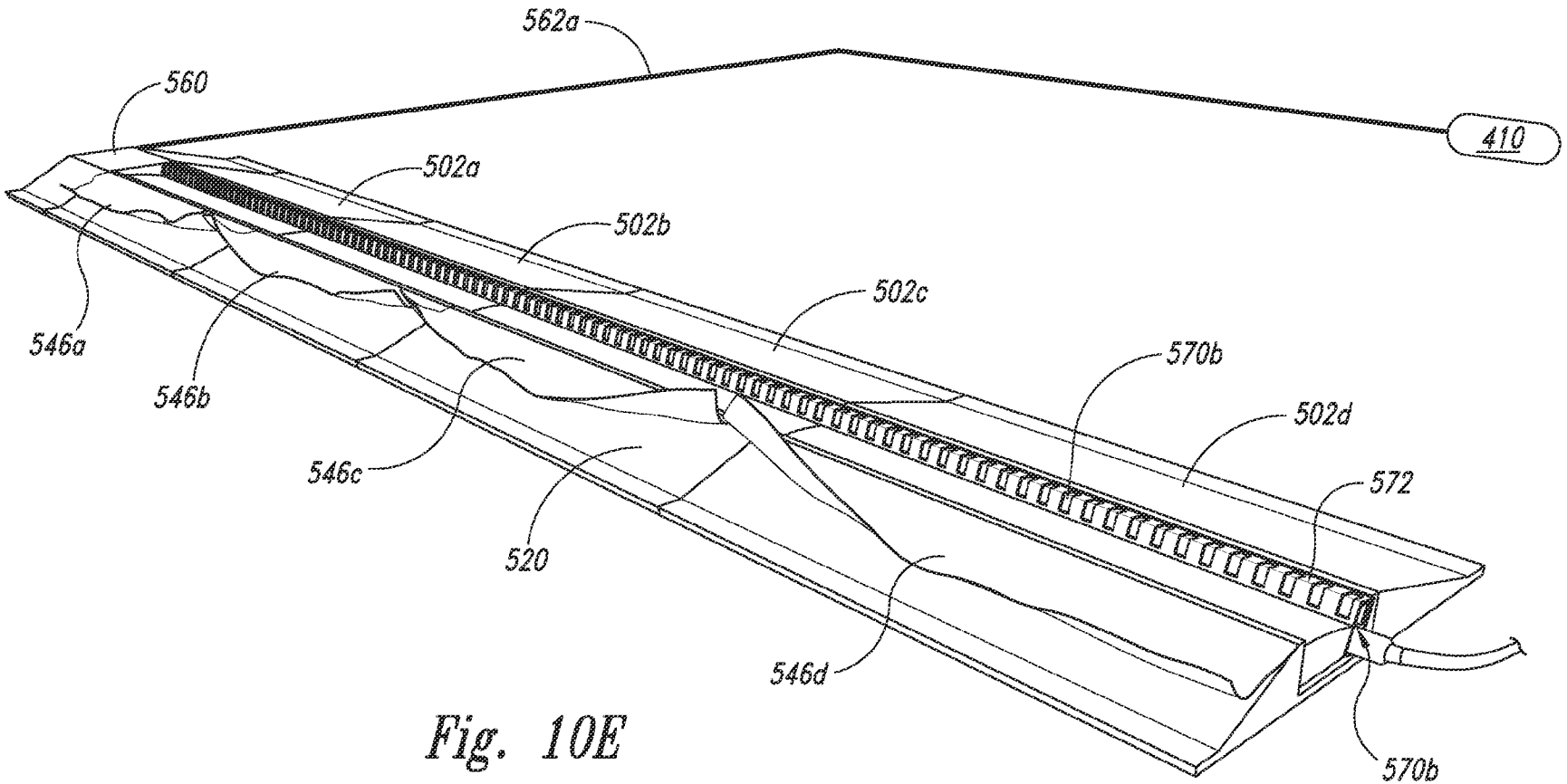

FIG. 10E is a perspective view illustrating a portion of the vehicle immobilizing device 500 in the deployed configuration. As discussed above, the immobilizing device 500 can include one or more segments 502 coupled end-to-end. The control segment 560 is shown coupled to segment 502*a* of the immobilizing device 500 shown in FIG. 10E. FIG. 10E also shows cable 562*a* extending to the sensor 410 (not shown) in front of the immobilizing device 500, the actuator mechanism 570 in its actuated configuration, and the second rectangular member 570*b* proximate to the top surface 572. FIG. 10E particularly shows the spikes 6 decoupled from the second rectangular member 570*b*, the covering 546 opened, e.g., overlying the trailing ramp 520, and the snaring member 9 and tethers 702 extracted from the deployment module 540. Certain embodiments of the covering 546 according to the present disclosure may be segmented (individual covering segments 546*a-d* are shown in FIG. 10E) similar to the segments 502. The covering 546 may include a single integral cover extending the length of the deployment module 540 or include a number of segments less than, equal to, or greater than the number of segments 502.

Figure 11A:
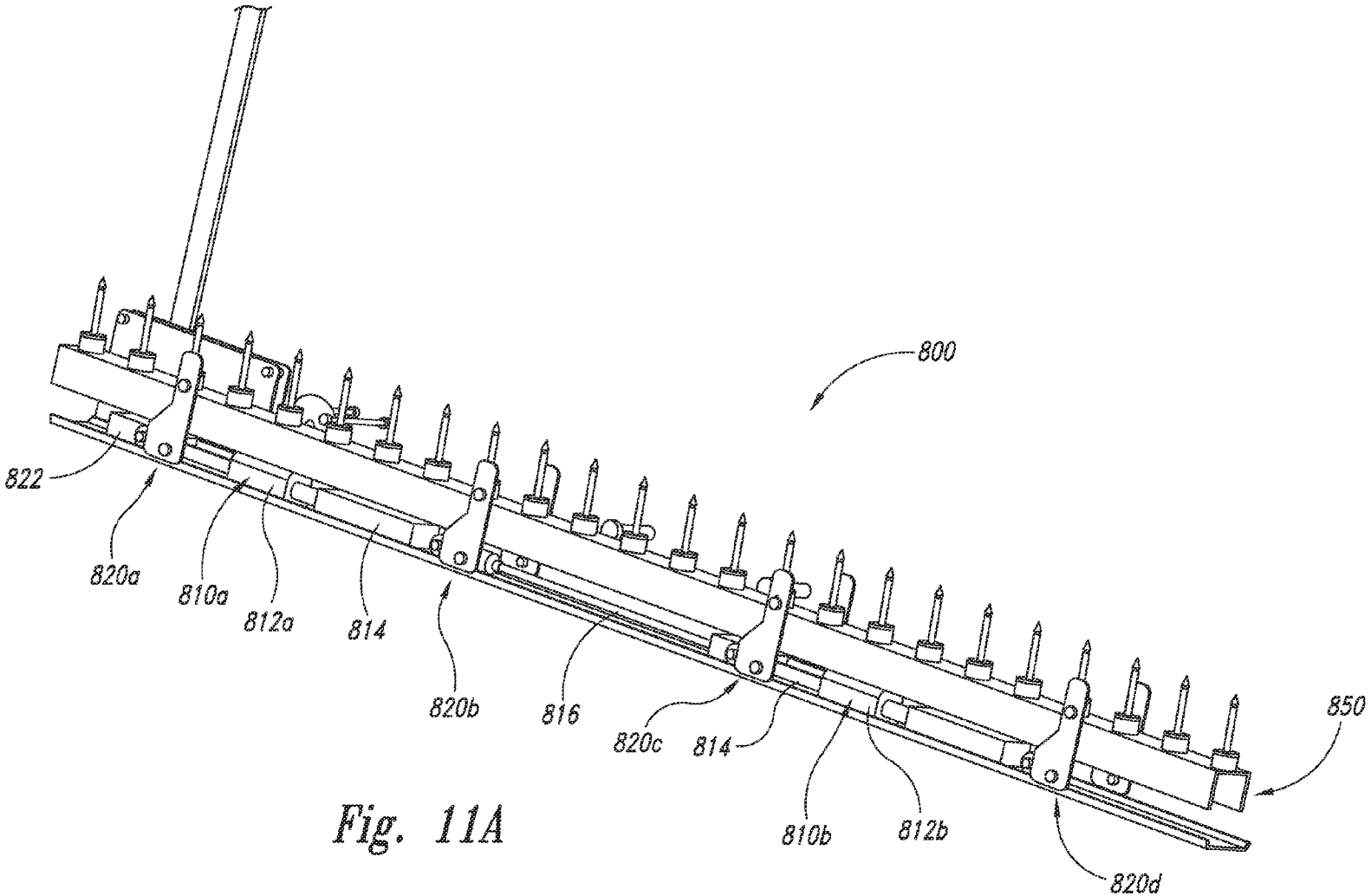
FIGS. 11A-11C are perspective views illustrating an embodiment according to the present disclosure of the actuator mechanism shown in FIGS. 10A-10D.
Figure 11B:
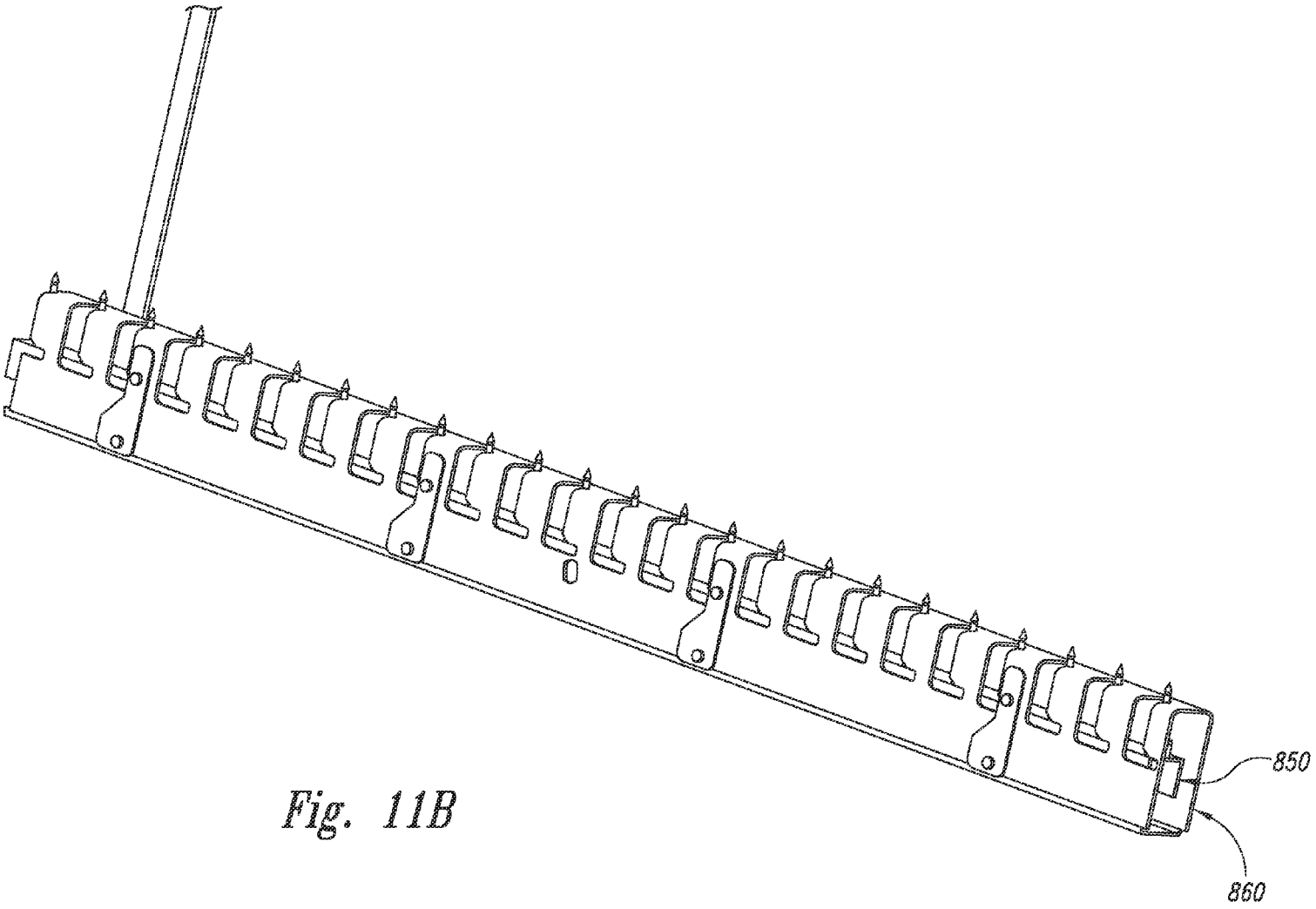
Figure 11C:
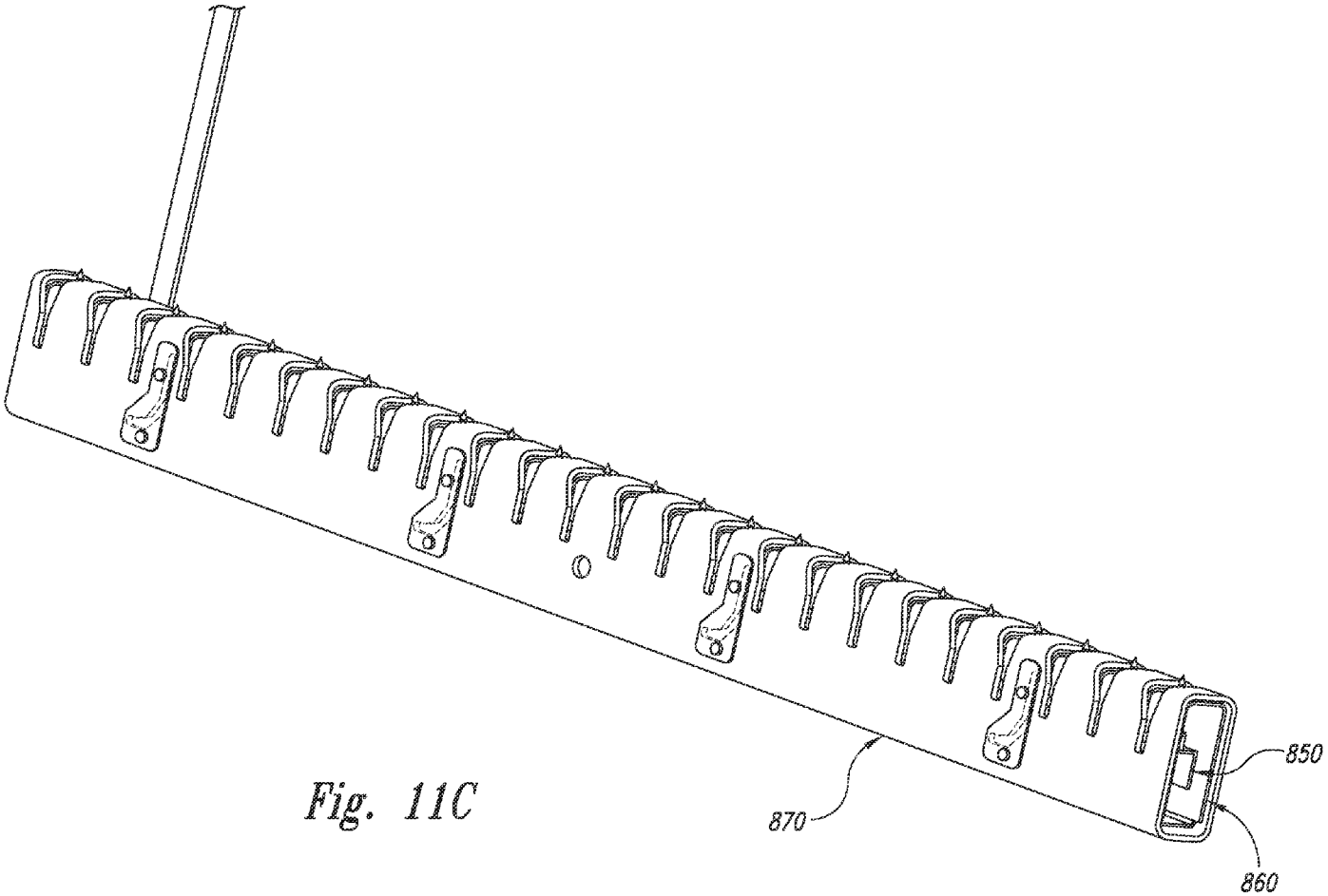

FIGS. 11A-11C are perspective views illustrating another embodiment according to the present disclosure of an actuator mechanism 800. The actuator 800 preferably includes one or more actuators 810 (e.g., two actuators 810*a* and 810*b* are shown in FIG. 11A) operably coupled by one of more linkages 820 (e.g., four linkages 820*a*-820*d* are shown in FIG. 11A) to a set of overlapping members 850, 860 and 870. A single actuator 810 may be included; however, it is preferable to include a plurality of redundant actuators to increase the reliability of the actuator mechanism 800. Individual actuators 810 may include, for example, a piston/cylinder combination, a motor, or other known devices that convert potential energy (e.g., compressed gas, unfired pyrotechnic material, electrical energy in a storage battery, etc.) to kinetic energy (e.g., linear motion, rotary motion, etc.). In the embodiment shown in FIG. 11A, each actuator 810 includes pneumatically operated piston/cylinder combination 812 and a longitudinally extending piston rod 814. A connecting rod 816 operably couples together the piston rods of the actuators 810 to permit either or both of the actuators 810 to cause or prevent both piston rods 814 from translating generally parallel to the longitudinal axis A of the immobilizing device 500.

Individual linkages 820 are coupled to the piston rods 814; preferably, at each end of the piston rods 814. As shown in FIG. 11A, each linkage 820 preferably includes a slide 822, one or more crank arms 824, and a wrist pin 826. Each slide 822 is displaced by virtue of being operably coupled to at least one of the piston rods 814. Preferably, the motion of individual slides 822 is guided along a path, e.g., in a straight line. One or more of the crank arms (not shown) extend between and pivotally couple together individual slides 822 with an individual wrist pin 826 (see FIG. 12A). Each wrist pin 826 preferably extends transversely from the corresponding crank arm(s).

Individual wrist pins 826 operatively engage corresponding tracks or grooves in each of the overlapping members 850, 860 and 870. The first member 850 includes a first track 852 that generally extends parallel to the longitudinal axis A. Accordingly, the first track 852 provides the wrist pin 826 with a range of longitudinal movement that does not effect movement of the first member 850. The first member 850, however, responds in kind to movement of the wrist pin 826 that is perpendicular to the longitudinal axis A. The second member 860 overlaps the first member 850 and includes a second track 862 that extends generally perpendicular to the longitudinal axis A. Accordingly, the second track 862 provides the wrist pin 826 with a range of movement perpendicular to the longitudinal axis A that does not effect movement of the second member 860. The second member 860, however, responds in kind to movement of the wrist pin 826 that is parallel to the longitudinal axis A. Preferably, the second track 862 may have a so-called "dog-leg" shape as best seen in FIGS. 12A-12D. The third member 870 overlaps the second member 860 and includes a third track 872 that guides the movement of the wrist pin 826. Preferably, the third track 862 may have a generally L-shape as best seen in FIGS. 12A-12D. Preferably, the third member 862 is generally fixed with respect to the actuator 810, the first member 850 moves relative to the second member 860 and relative to the third member 870, and the second member 860 moves relative to the first member 850 and the third member 870.

Figure 12A:
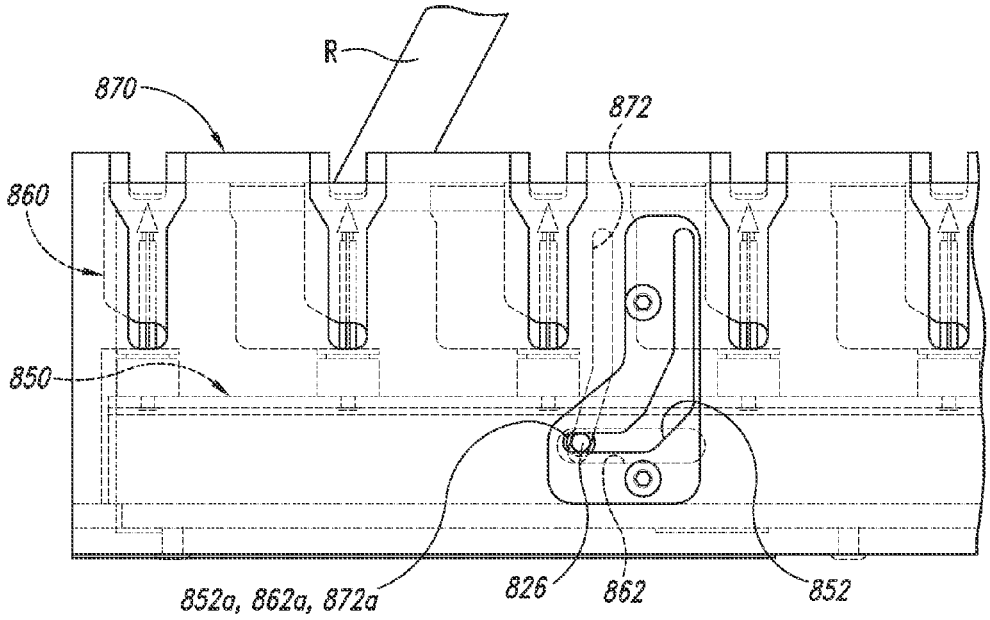
FIGS. 12A-12D illustrate an actuation sequence of the actuator mechanism actuator mechanism shown in FIGS. 11A-11C.

FIGS. 12A-12D illustrate an embodiment according to the present disclosure of an actuation sequence of the actuator mechanism 570 shown in FIG. 11A-11C. In the stowed arrangement of the immobilizing device 500 as shown in FIG. 12A, the piston rod 814 is extended and the wrist pin 826 is positioned proximate to a first end 852*a* of the first track 852, a first end 862*a* of the second track 862, and a first end 872*a* of the third track 872.

Figure 12B:
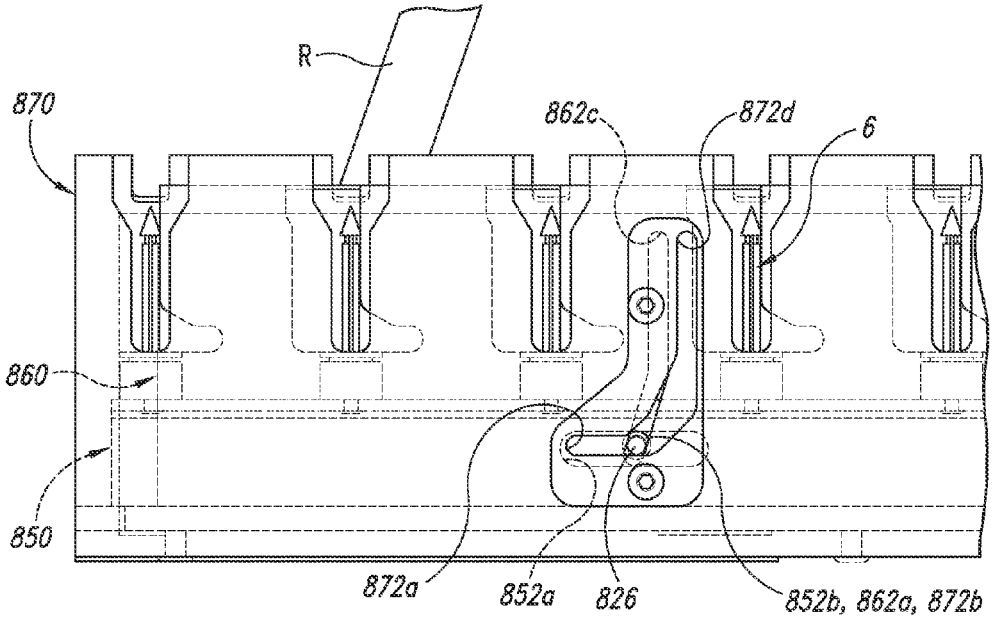

Initiating the actuator 810 displaces the piston rod 814 and the slide 822 to the right in FIG. 12B. In response, the crank arm 824 causes the wrist pin 826 to move. The wrist pin 826 is guided generally longitudinally by the third track 872 along a longitudinal path to a first intermediate position 872*b* where the third track 872 begins to also guide the wrist pin 826 perpendicular to the longitudinal axis A. Concurrently, the wrist pin 826 moves in the first track 852 to an intermediate position 852*b* such that the first member 850 generally does not move relative to the third member 870. Also concurrently, the wrist pin 826 remains proximate to the first end 862*a* of the second track 862 such that the wrist pin 826 moves the second track 862. Thus, the second member 860 moves generally longitudinally relative to the third member 870.

Figure 12C:
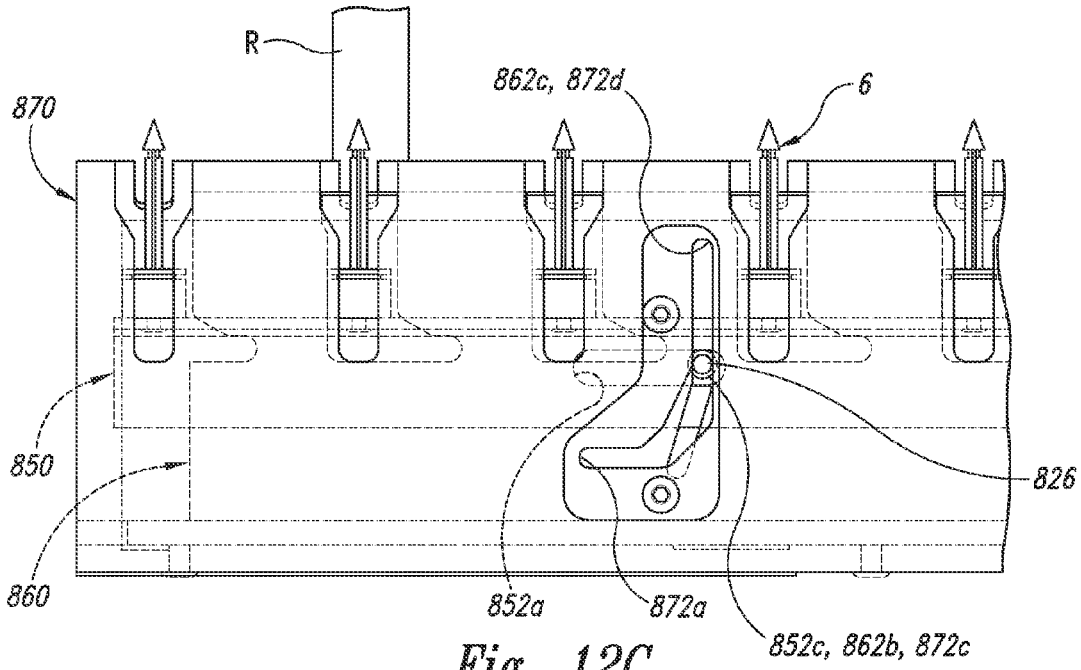

Continuing to operate the actuator 810 in the same direction continues to displace the piston rod 814 and the slide 822 to the right in FIG. 12C and the crank arm 824 continues to cause the wrist pin 826 to move. The wrist pin 826 is guided by the third track 872 along a generally diagonal path to a second intermediate position 872*c* where the third track 872 begins to guide the wrist pin 826 generally perpendicular to the longitudinal axis A. Concurrently, the wrist pin 826 moves in the first track 852 to a second end 852*c* but the first member 850 still generally does not move relative to the third member 870. Also concurrently, the wrist pin 826 moves to an intermediate position 862*b* in the second track 862 such that the wrist pin 826 ceases to longitudinally move the second track 862. Thus, the second member 860 reaches the end of is range of generally longitudinal movement relative to the third member 870.

Figure 12D:
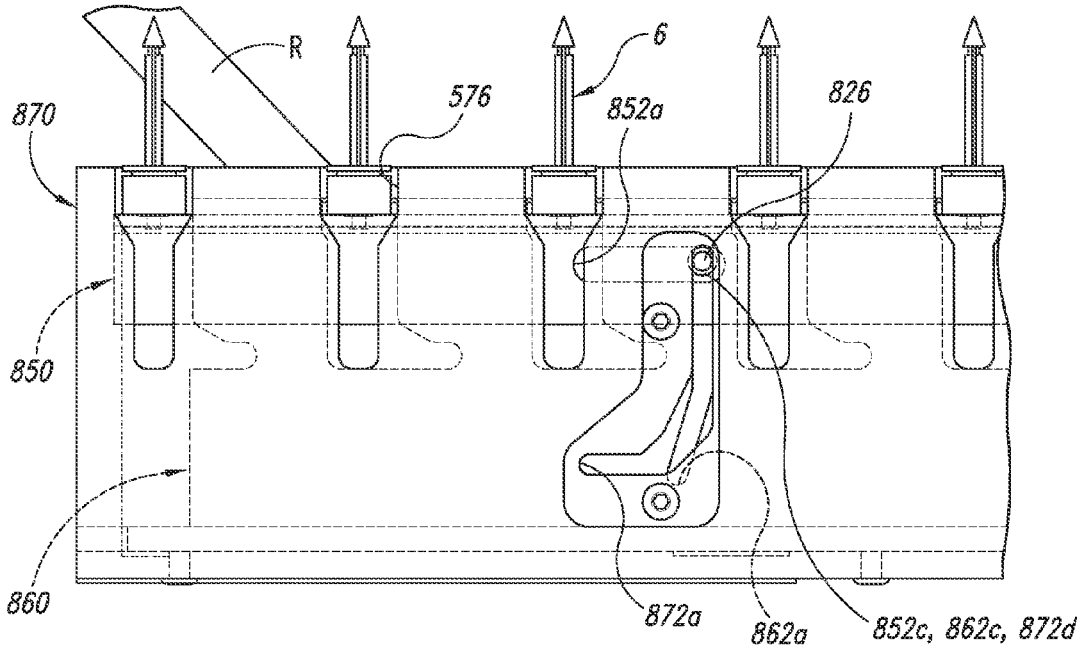

Continuing to operate the actuator 810 in the same direction continues to displace the piston rod 814 and the slide 822 to the right in FIG. 12D and the crank arm 824 continues to cause the wrist pin 826 to move. The wrist pin 826 is guided by the third track 872 along a path that is generally perpendicular to the longitudinal axis A to a second end 872*d* of the third track 872. Concurrently, the wrist pin 826 remains at the second end 852*c* in the first track 852 and the wrist pin 826 moves the first track 852 in a direction generally perpendicular to the longitudinal axis A. Thus, the first member 850 moves relative to the third member 870. Also concurrently, the wrist pin 826 moves in the second track 862 to a second end 862*c* but the second member 860 generally does not move relative to the third member 870.

Thus, according to the embodiment of the present disclosure shown in FIGS. 11A-12D, the second member 860 moves parallel to the longitudinal axis A relative to the first member 850 and relative to the third member 870. This relative movement of the second member 860 uncovers the spikes 6 beneath slots 876 in the third member 870. Also, the first member 850 moves perpendicular to the longitudinal axis A relative to the second member 860 and relative to the third member 870. This relative movement of the first member 850 extends the spikes 6 through the slots 876 to the armed arrangement of the immobilizing device 500.

FIGS. 11A-12D also show an optional resetting tool R that may be used to reverse the direction of the piston 814. Accordingly, the resetting tool R may be used to reset the actuator mechanism 800 to the stowed arrangement of the immobilizing device 500.

Figure 13A:
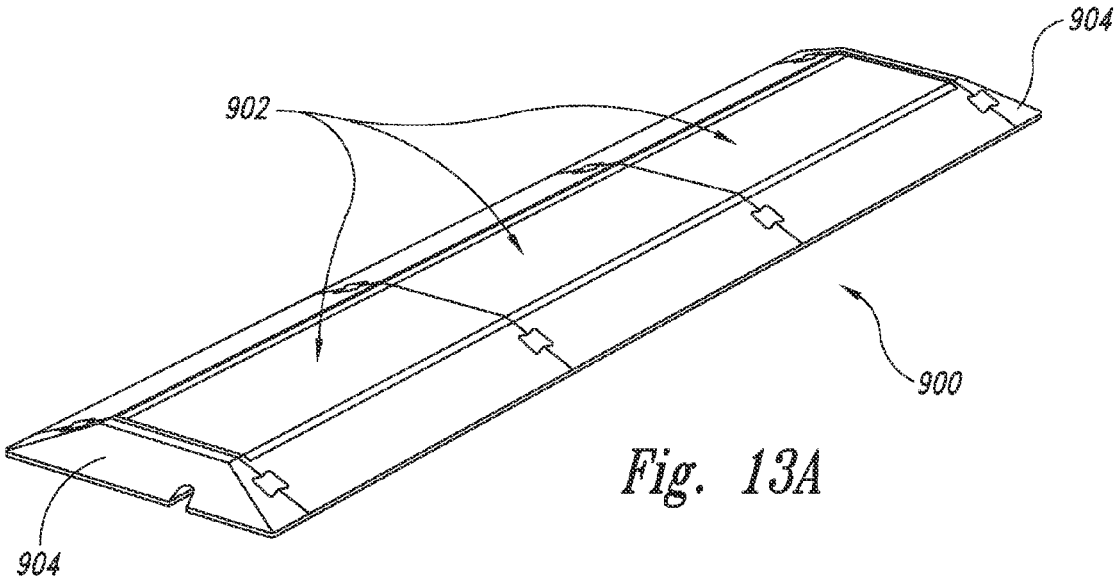
FIGS. 13A-13H illustrate a vehicle immobilizing device according to a further embodiment of the present disclosure.
Figure 13B:
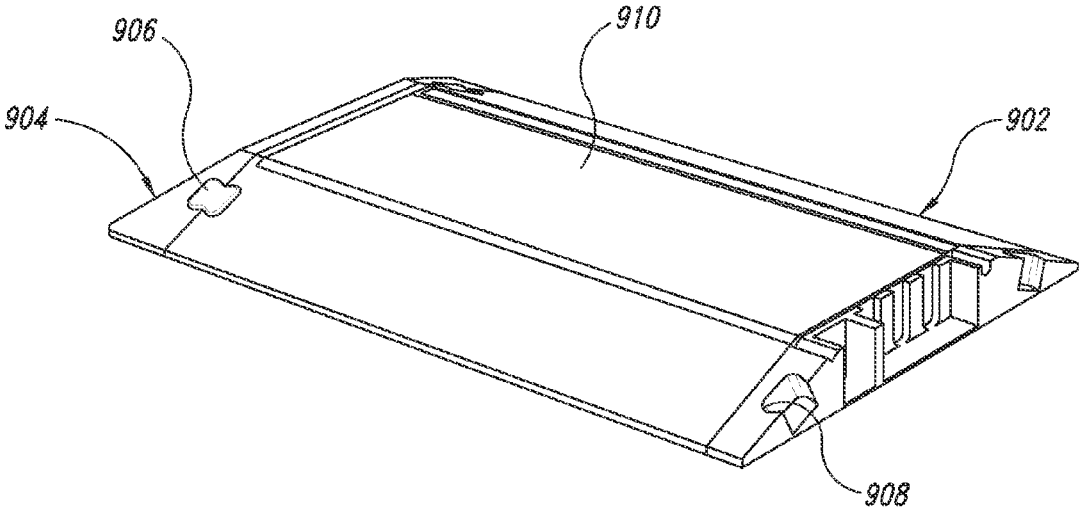
Figure 13C:
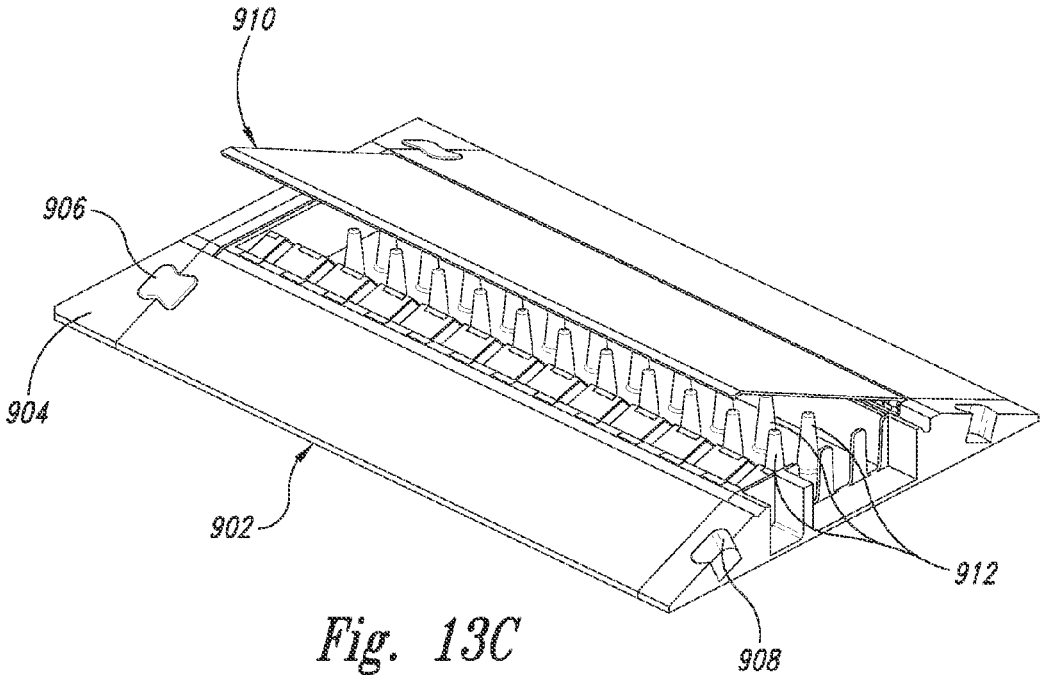
Figure 13D:
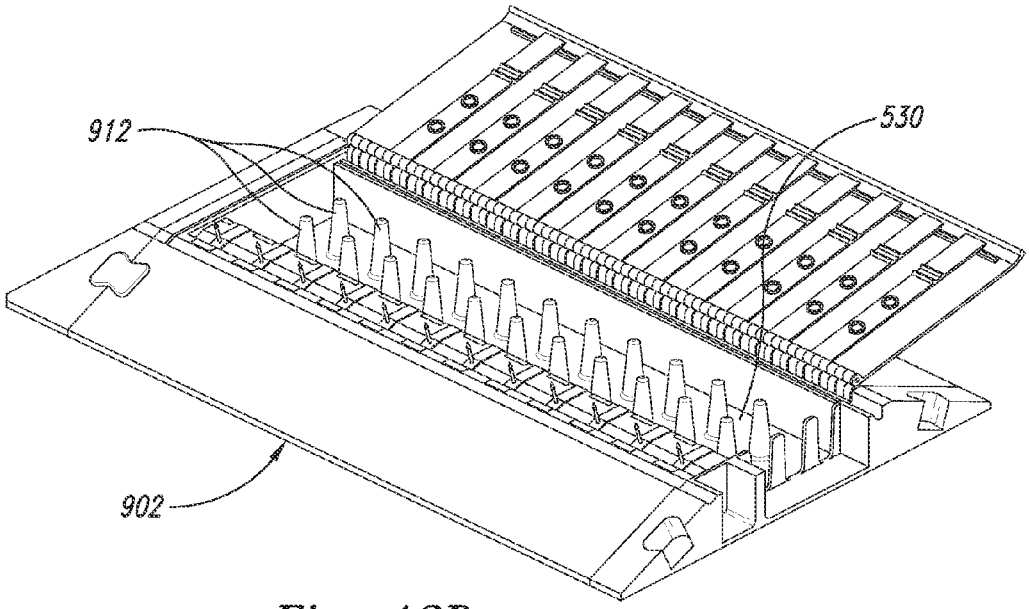
Figure 13E:
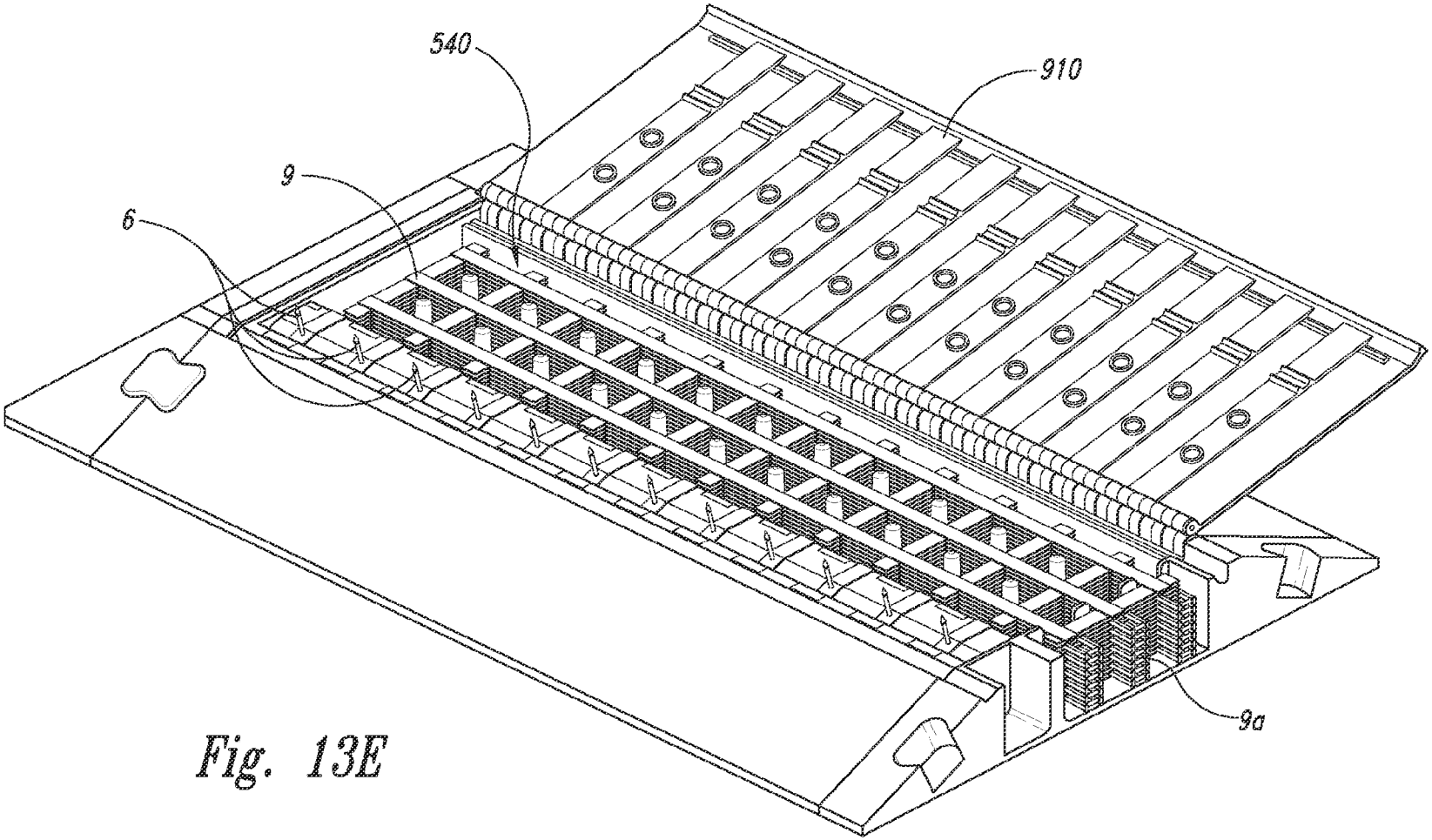
Figure 13F:
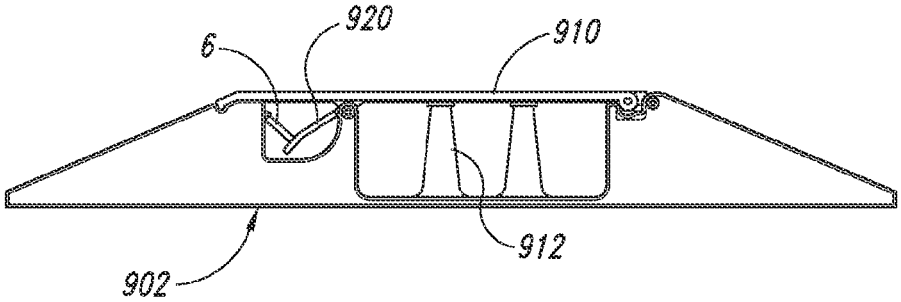
Figure 13G:
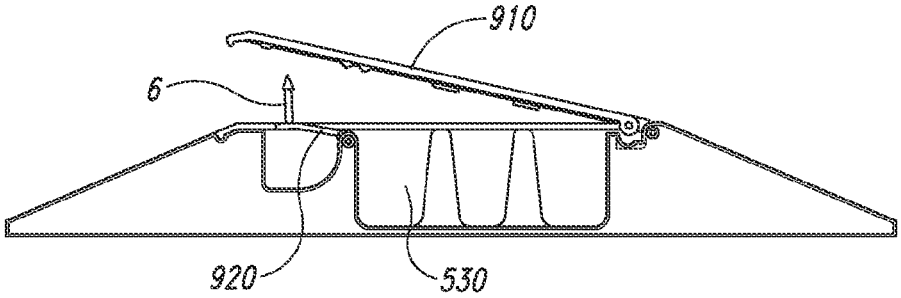
Figure 13H:
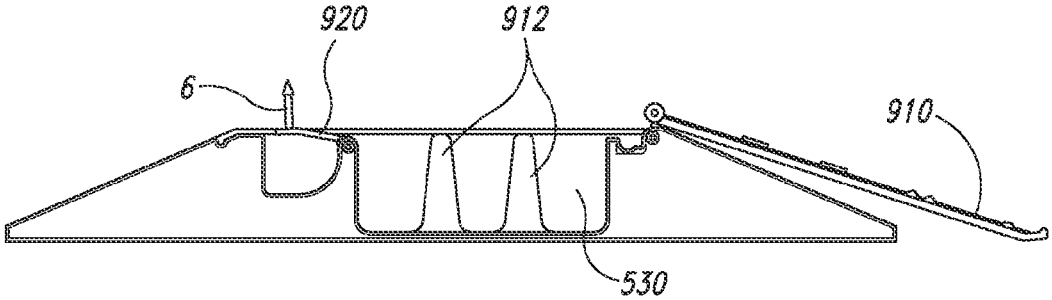

FIGS. 13A-13H illustrate another embodiment according to the present disclosure of an immobilizing device 900. In particular, the immobilizing device 900 includes a shield 910 disposed over a deployment module 540 disposed in a cavity 530 of the immobilizing device 900. Accordingly, the shield 910 supports the wheel T as it traverses the immobilizing device thereby preventing or avoiding the wheel T from impacting, compressing, or otherwise disturbing the deployment module 540. The shield 910 may be movable with respect to at least one of the ramps 510,520 so as to reveal the cavity 530 in the extended arrangement of the snaring member 9 and/or without causing an appreciable detrimental effect on extending the snaring member 9 from the immobilizing device 900. FIG. 13A shows the immobilizing device 900 including three housing segments 902 and two end segments 904 coupled together. FIG. 13B shows another embodiment according to the present disclosure for linking together one of the operating segments 902 and one of the end segments 904. In particular, a peg 906 may be fitted into corresponding portions of cooperative recesses 908. FIGS. 13C and 13D show the shield 910 in two partially open configurations. One or more supports 912 may be provided in the cavity 530 to support the shield 910 when it is subjected to the weight of the wheel T. FIG. 13E shows a snaring member 9 fitted in the cavity 530 of the immobilizing device 900. The snaring member 9 may have individual meshes cincturing the supports 912 and mesh couplers 9*a* may be included to link together snaring member segments that are disposed in adjacent housing segments 902. FIGS. 13F-13G show a sequence for arming the immobilizing device 900. In the stowed arrangement shown in FIG. 13F, the spikes 6 may be mounted on a pivot plate 920. A biasing member (not shown in FIG. 13G) may cause the pivot plate 920 and the spikes 6 to extend from an individual operating segment 902 when the immobilizing device 900 is arming. In the armed arrangement shown in FIG. 13H, a lock (not shown) maintains the pivot plate 920 such that the spikes 6 are extended and the shield 910 is pivoted out of the way, e.g., onto the trailing ramp.

Figure 14A:
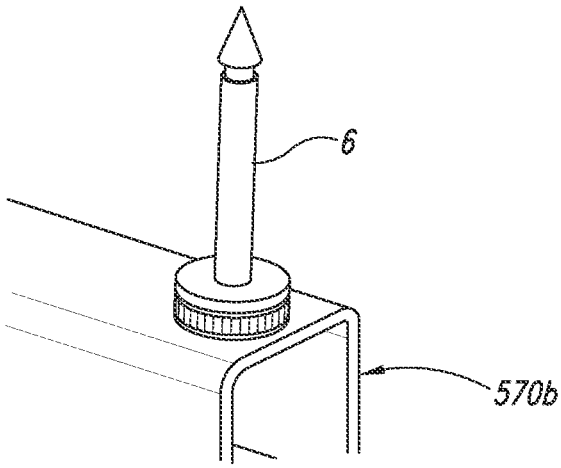
FIGS. 14A and 14B are detail views illustrating releasably spike couplings according to embodiments of the present disclosure.
Figure 14B:
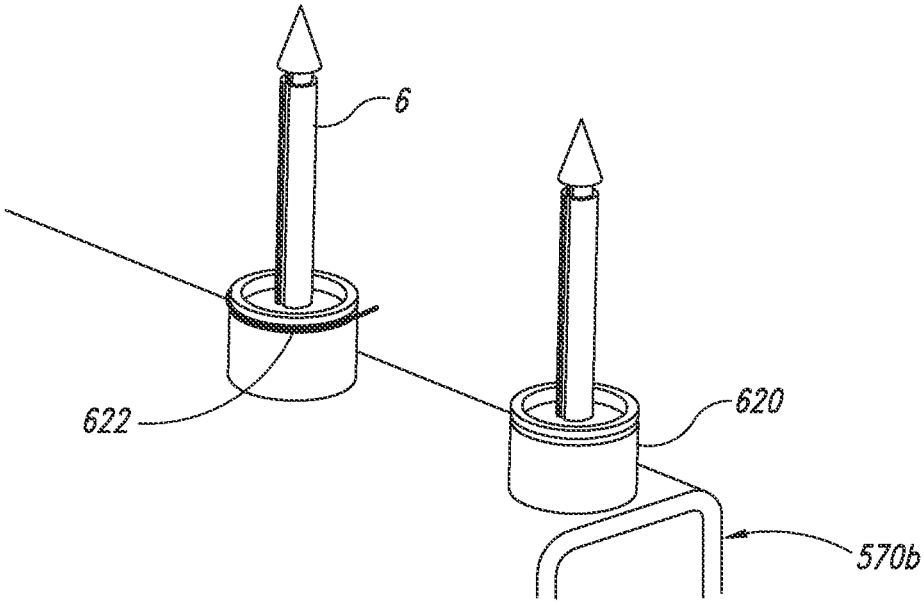

FIGS. 14A and 14B are detail views illustrating certain embodiments according to the present disclosure for releasably coupling spikes to an actuator mechanism. In the partially deployed configuration of the immobilizing devices 500 or 900, individual spikes 6 can be temporarily and releasably coupled to the second rectangular member 570*b* by adhesion, magnetism, or any suitable coupling that is releasable with a predetermined force. FIG. 14A shows one example of a suitable temporary and releasable coupling including Dual Lock™ Reclosable Fastener manufactured by 3M™ of St. Paul, Minn. FIG. 14B shows another method of temporarily and releasably coupling individual spikes 6 to, for example, the second rectangular member 570*b*. In particular, at least one cup 620 is preferably provided on the second rectangular member 570*b*. A resilient member 622 may extend across a portion of the cup 620 for biasing individual spikes 6 into the cup 620.

Figure 15A:
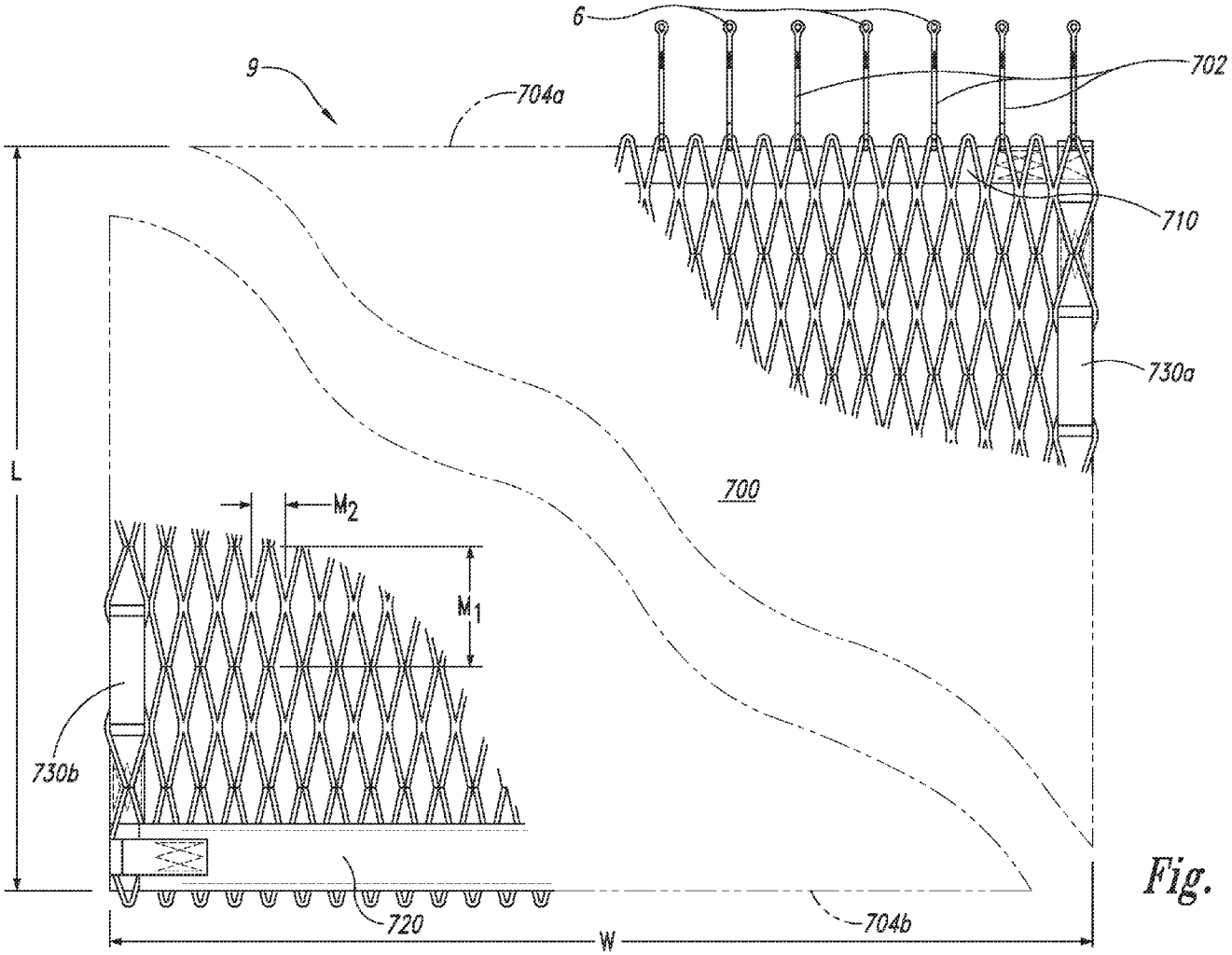
FIG. 15A is a partial view of an embodiment of a snaring member for the vehicle immobilizing device of FIGS. 7A-7D.

FIG. 15A is a partial plan view showing portions of opposite corners of an embodiment of the snaring member 9 in an extended configuration. The snaring member 9 can include a net 700, e.g., a polyethylene mesh net, having a width W preferably suitable for encompassing the track of the wheels of a target vehicle and a length L preferably suitable for extending at least approximately 1.25 times around the circumference of the wheels of the target vehicle. For example, if the target vehicle has a track of approximately 65 inches and rides on wheels having an outer diameter of approximately 28 inches, the net 700 may have a width W of approximately 190 inches and a length L of at least approximately 110 inches. The width of the net 700 in the example may be selected on the basis of the number of segments 502 of the immobilizing device 500, a predetermined possible variance in where the track of the target vehicle may traverse along the length of the immobilizing device 500, a predetermine dimension in excess of the target vehicle track, and/or a combination of these or other factors. A preferable minimum length of the net 700 in the example may be selected by computing 1.25 times the circumference of the wheel.

The net 700 can have meshes that, in the contracted arrangement of the net 700, have an approximately diamond shape with a major axis M1 between distal opposite points approximately three to four times greater than a minor axis M2 between proximal opposite points. For example, the size of individual meshes in the widthwise direction may be approximately one inch in the contracted arrangement, e.g., stowed configuration, of the net 700, and the size of individual meshes in the lengthwise direction may be approximately 3.5 inches in the contracted arrangement of the net 700. Certain other embodiments according to the present invention may have approximately square shaped meshes.

The net 700 may be assembled according to known techniques such as using "Weavers Knots" and/or a "Fisherman's Knot" to join lengths of cord and form the mesh. Certain embodiments according to the present disclosure may include coating the net material with an acrylic dilution, e.g., one part acrylic to 20 parts water, to aid in setting the knots and prevent them from slipping or coming undone.

The applicants have determined that it is desirable to provide a widthwise stretch ratio of approximately 3:1. Accordingly, each mesh is reshaped or stretches in the widthwise direction, e.g., parallel to the wheel track of the target vehicle, to a dimension approximately three times greater than its initial dimension. For example, a net 700 having a 1.75 inch by 1.75 inch mesh size (unstretched) may be approximately 3.75 inches measured on the bias (stretched) when the net 700 is entangled around the wheels of a target vehicle in the fully deployed configuration of the immobilizing device 500. According to this example, approximately 65 inches of the contracted net 700 that is captured by the wheel track of the target vehicle is expanded to approximately 245 inches that may become entangled on features of the undercarriage of the target vehicle approximately within its wheel track.

Referring again to FIG. 15A, the ensnaring member 9 may also include a first strip 710 along a leading edge 704*a* of the net 700, a second strip 720 along a trailing edge 704*b* of the net 700, and/or lengthwise strips 730 (individual lengthwise strips 730*a* and 730*b* are shown in FIG. 15). The first strip 710 may include, for example, approximately one inch wide nylon webbing that is sewn to the net 700 with rip-stitching. Accordingly, the style and/or material of the stitching securing the first strip 710 to the net 700 allows the first strip 710 to at least partially detach from the net 700 in response to the wheels of the target vehicle extracting the net 700 from the deployment module 540. The second strip 720 includes a single strip extending approximately the entire width of the net 700. The second strip 720 may include, for example, approximately two inch wide nylon webbing that is securely sewn to the net 700 such that the second strip 720 remains at least approximately secured to the net 700 in response to the wheels of the target vehicle extracting the net 700 from the deployment module 540. Individual lengthwise strips 730 may include single strips intertwined with the meshes of the net 700 between the first and second strips 710 and 720. The lengthwise strips 730 may be securely coupled to the first and second strips 710 and 720 such that the lengthwise strips 730 remain at least approximately secured to the first and second strips 710 and 720 in response to the wheels of the target vehicle extracting the net 700 from the deployment module 540.

The first, second and/or lengthwise strips 710, 720 and 730 may maintain the approximate size and approximate shape of the net 700 in its contracted configuration, e.g., in a stowed configuration of the immobilizing device 500. The second strip 720 that is secured to the trailing edge 704*b* of the net 700 may aid in cinching the snaring member 9 onto the wheels of the target vehicle so as to seize rotation of the entangled wheel(s) and thereby immobilize the target vehicle. The lengthwise strips 730 also may aid in cinching the snaring member 9 onto the wheels of the target vehicle and/or minimize net flaring as the net 700 wraps around the wheels of the target vehicle.

Figure 15B:
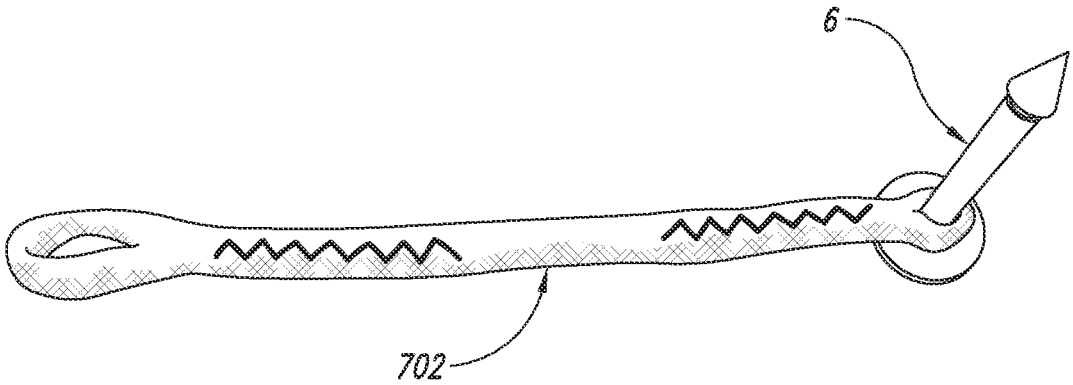
FIG. 15B is a perspective view of an embodiment of a tether and a spike for the snaring member of FIG. 15A.

FIG. 15B is a detail view of one embodiment of a tether 702 coupled to an individual spike 6. The tethers 702 may couple individual meshes at the leading edge 704*a* of the net 700 to corresponding spikes 6. Individual tethers 702 may be made of the same material as the net 700 or any other material that is suitable for coupling the spikes 6 and the net 700. Loops may be formed at either end of the tether 702 by known weaving or braiding techniques.

Figure 16A:
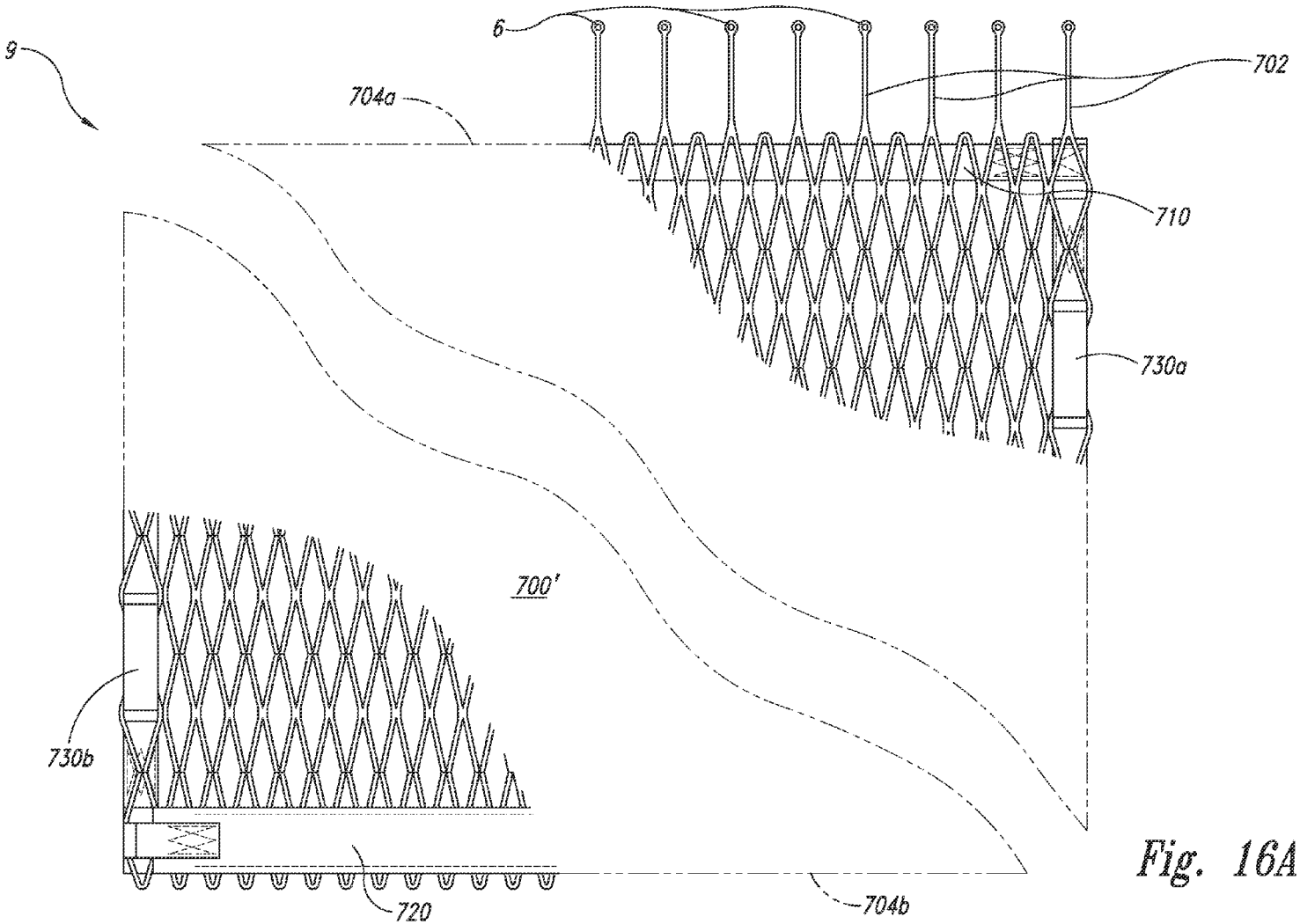
FIGS. 16A and 16B are partial views of other embodiments of a snaring member for the vehicle immobilizing device of FIGS. 7A-7D.
Figure 16B:
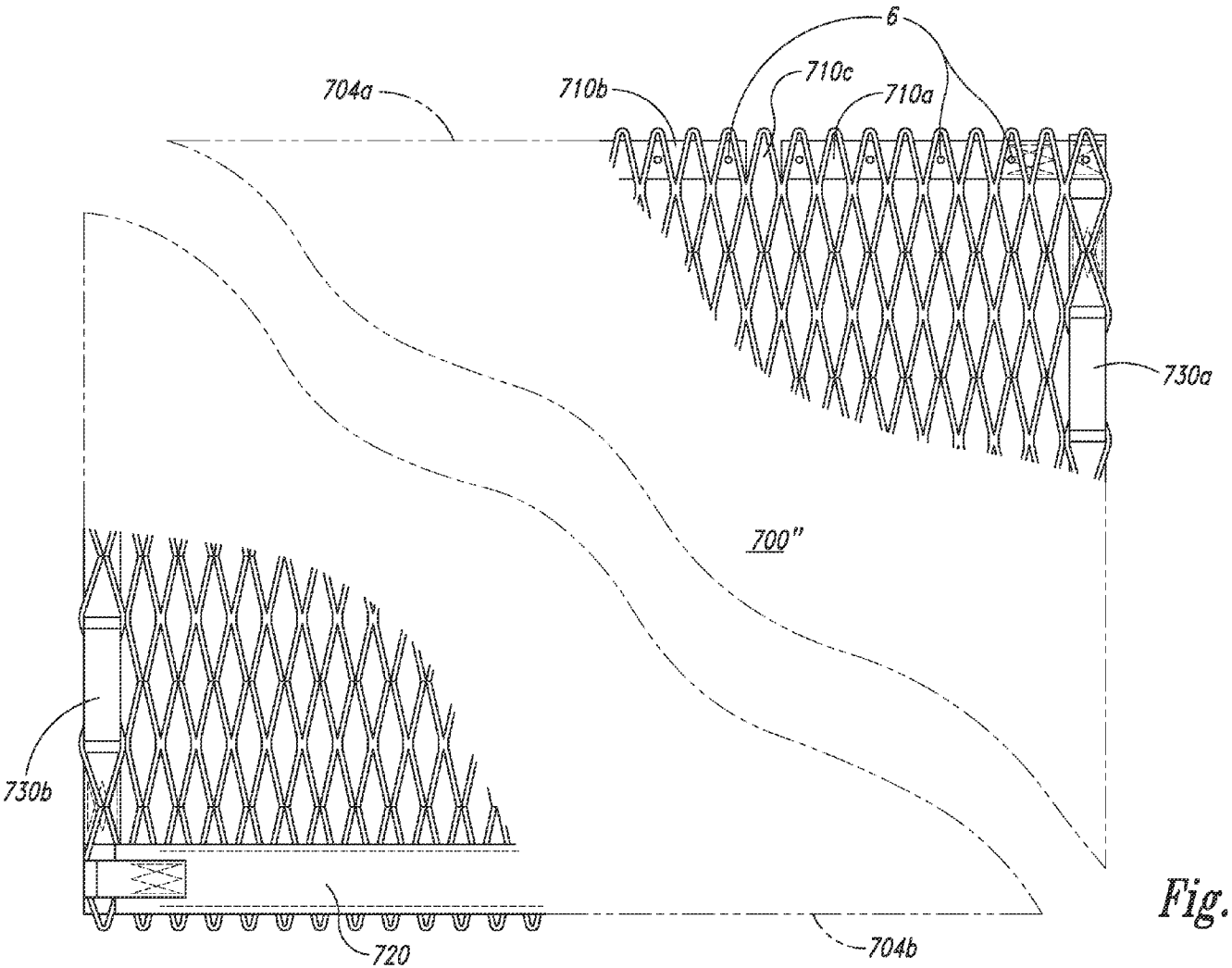

FIGS. 16A and 16B are partial views of other embodiments of a snaring member for the vehicle immobilizing device of FIGS. 7A-7D. FIG. 16A shows an example of certain embodiments according to the present disclosure that integrate the tethers 702 into the construction of a net 700'. The chords used to make the net 700' may extend beyond the leading edge 704*a* of the net 700' and couple to individual spikes 6, or the spikes 6 may be integrated into the leading edge 704*a* of the net 700 as shown, for example, in FIG. 16A. FIG. 16B shows an example of certain other embodiments according to the present disclosure that omit separate tethers 702 and directly couple the spikes 6 to a net 700", preferably to the chords used to make the net 700".

The first strip 710 may include a plurality of segments (e.g., two segments 710*a* and 710*b* are shown in FIG. 16B) such that at least one break 710*c* in the first strip 710 will be positioned within the wheel track of the target vehicle. A segmented first strip 710 may be used in certain embodiments according to the present disclosure including, e.g., the nets 700, 700' or 700".

According to the present disclosure, the net 700 may be constructed to satisfy different performance requirements. For example, a first embodiment of the net may be constructed exclusively of a single type of fiber in order to satisfy a first performance requirement; however, a second embodiment of the net may be constructed of two or more types of fibers in order to satisfy a second performance requirement. The phrase "performance requirement" may refer to the ability to absorb momentum. Examples of different performance requirements may include stopping a first vehicle weighing up to 6,000 pounds and traveling at up to 50 miles per hour, or stopping a second vehicle weighing up to 40,000 pounds and traveling at up to 30 miles per hour. The performance requirement to stop the second vehicle is approximately four times the performance requirement to stop the first vehicle. The inventors have discovered that the deployment module 540 may include at least some commonalities, e.g., the case 542 may have a common size suitable to be fitted into the cavity 530, and that construction of the net 700 can be varied so as to provide a variety of deployment modules 540 that satisfy different performance requirements and/or have different manufacturing costs.

Figure 17:
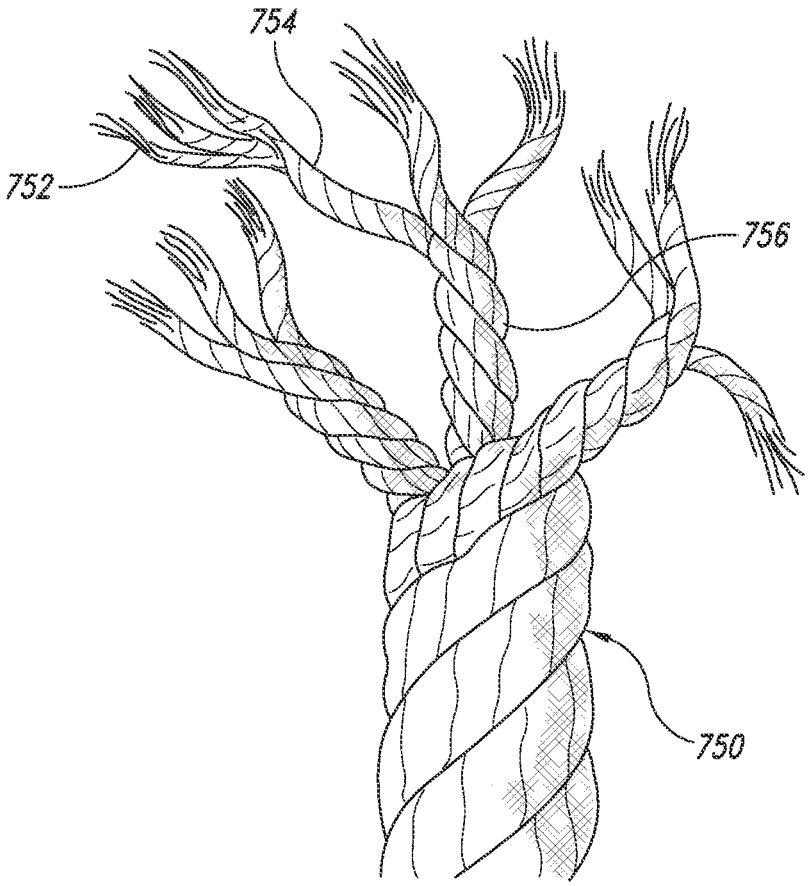
FIG. 17 is a detail view of an embodiment of a cord for the snaring member of FIG. 15 according to an embodiment of the present disclosure.

FIG. 17 is a detail view of an embodiment according to the present disclosure of a cord 750 that may be used to construct the snaring member of FIG. 15 and/or the tether 702 of FIG. 16. The cord 750 may be constructed of fibers or filaments 752 that may be twisted together to produce a yarn 754. Certain embodiments according to the present disclosure include twisting the filaments 752 in a right laid direction also known as a "Z-twist." A plurality of yarns 754 (three are shown in FIG. 17) may be twisted together to produce a strand 756. Certain embodiments according to the present disclosure include twisting the yarns 754 in a left laid direction also known as an "S-twist." A plurality of strands 756 (three are shown in FIG. 17) may be twisted together to produce the cord 750. Certain embodiments according to the present disclosure include twisting the strands 756 in the right laid direction, i.e., with the "Z-twist." Other embodiments according to the present disclosure may include more or less than three yarns 754, more or less than three strands 756, and/or different combinations of S and Z twists. Other techniques, e.g., braiding rather than twisting, may also be used in the construction of the cord 750.

The cord 750 may include a hybrid construction in certain embodiments according to the present disclosure. For example, the filaments 752 may include a plurality of materials, a variety of materials may be used for individual yarns 754, a variety of materials may be used for individual strands 756, and/or a combination of each of these may be included in the construction of the cord 750. Examples of suitable materials and some of their characteristics are described in Table A.

TABLE A

| Material | Cord Size | Strength | Lbs/100 ft | Abrasion | Cost |
|---|---|---|---|---|---|
| Polyester | 0.25 | 3000 | 2.0 | Excellent | Low |
| Spectra ® | 0.25 | 6500 | 1.7 | Excellent | Medium |
| Kevlar ® | 0.25 | 6600 | 2.0 | Fair | Medium |
| Technora ® | 0.25 | 8000 | 2.2 | Good | High |
| Dyneema ® | 0.25 | 8400 | 1.7 | Excellent | High |

The cord size specified in Table A is in inches and the strength specified in Table A refers to the tensile strength in pounds. The abrasion and cost characteristics are relative to the materials specified in Table A. Certain embodiments according to the present disclosure may also use larger or smaller size cords, e.g., #96 size cord which has a diameter of approximately 0.136 inch.

A mixture of fiber, yarn, strand or cord materials according to certain embodiments of the present disclosure may be used to construct a net 700 having a set of characteristics, e.g., performance, weight, abrasion resistance and cost, that are different than using a homogenous fiber, yarn, strand and cord for the entire net 700. Accordingly, the inventors have discovered that a variety of nets 700 may be used to customize the deployment module 540 for different implementations, and that other features of the immobilizing device 500, e.g., segments 502 and 560, may share at least some commonality.

A method according to embodiments of the present disclosure for implementing a vehicle immobilizing device will now be described. A vehicle immobilizing device 100, 200, 300 or 400 can be positioned in a "decision zone" that can be positioned prior to a "stop zone" at a checkpoint, an entry gate, or any other location at which it is desirable to screen vehicle traffic. A vehicle approaching the location would typically slow to allow security personnel manning the location to have an opportunity to investigate the vehicle as it comes to a stop in the decision zone. A friendly vehicle is typically allowed to pass through the decision zone and bypass the stop zone. In the event that a vehicle does not halt for investigation in the decision zone, the security personnel can selectively arm the vehicle immobilizing device 100, 200, 300 or 400 such that prior to the vehicle rolling over, for example, the vehicle immobilizing device 100, a sensor, e.g., sensor 410, will have activated the actuator mechanism 570 and deployed the spikes 6. As the vehicle rolls over the vehicle immobilizing device 100, the spikes 6 penetrate into and latch onto the leading tires of the vehicle. As the vehicle continues, the tires draw the snaring member 9 out of the speed-bump 1 and the snaring member 9 can twist and become entangled around the rotating tires. In turn, the spikes 7 are deployed out of the speed-bump 1 and penetrate into and latch onto the trailing tires of the vehicle. As the vehicle continues, the snaring member 5 is drawn out of the speed-bump 1 and can twist and become entangled around the rotating trailing tires. The entangled snaring members then will continue to twist until leverage against the under carriage of the vehicle brings the tires to a stop. Accordingly, the vehicle can be slowed and stopped in a controlled and non-lethal manner.

According to the present disclosure, other embodiments can include various features for deploying the trailing tire spikes. For example, the spikes 7 can be deployed after a time period that is less than the time it takes between the leading and trailing tires rolling over one of the vehicle immobilizing devices 100, 200, 300 or 400. For example, a smart logic timing device can be used to deploy the spikes 7 after a time period, e.g., not more than approximately 100 milliseconds, following deployment of the spikes 6. The trailing tire spikes can also be deployed upon the leading tire withdrawing a length of a snaring member, or based on contact of the trailing tires with the vehicle immobilizing device 100, 200, 300 or 400. Other techniques are suitable so long as the trailing tire spikes are deployed after the leading tire has rolled over the vehicle immobilizing device and before the trailing tire rolls on the vehicle immobilizing device.

According to the present disclosure, still other embodiments of can deploy the spikes by deflating or otherwise compressing the speed-bump to expose the spikes. Accordingly, the leading tires could deflate a first portion of a vehicle immobilizing device 100, for example, to expose and engage the spikes 6, and the trailing tires could subsequently deflate a second portion of the vehicle immobilizing device 100 to expose and engage the spikes 7.

According to the present disclosure, yet other embodiments can include a vehicle immobilizing device that is packaged in the form of or housed in a portable speed-bump that is meant to be positioned in the path of traffic at a selective location or pathway of traffic. The speed bump can also be used to slow down traffic and, unbeknownst to an operator of a particular vehicle, the speed bump can also selectively immobilize the particular vehicle with minimal damage and risk to the vehicle occupants.

According to the present disclosure, further embodiments of a vehicle immobilizing device can be remotely armed in anticipation of a particular vehicle. As the particular vehicle approaches the speed bump, the barbed spikes can be deployed from the speed bump to initiate a series of snaring events. Else, the vehicle immobilizing device can also be remotely disarmed prior to the vehicle reaching the speed-bump. Once disarmed, the vehicle immobilizing device can serve back as a conventional speed-bump for merely slowing traffic.

According to the present disclosure, still further embodiments of the vehicle immobilizing device can also be permanently or semi-permanently housed bellow the road grade on a drive way or pathway and remotely or directly activated in according to an aforementioned manner. According to other embodiments of the present disclosure, individual snaring members can be launched, e.g., pyrotechnically, from a housing toward the tires of a vehicle.

According to more embodiments of the present disclosure, spikes can be coupled to snaring members proximal to edges of the snaring members, at net joints (e.g., knots) of the snaring members, or distributed over the surface of the snaring members. A backing or doubling layer can be used to couple spikes to structural strands of a snaring member.

According to yet more embodiments of the present disclosure, spikes can be spring loaded or otherwise biased with respect to a housing of the speed-bump. Accordingly, releasing the spring or biasing element with an actuator can allow the spikes to be deployed.

According to still more embodiments of the present disclosure, a kit for field refurbishing the vehicle immobilizing device may contain a deployment module and/or a replacement energy source for activating the actuator mechanism.

Additional embodiments according to the present disclosure can include batteries or solar cells to provide electrical power for the vehicle immobilizing device, indicators for the state of the battery charge and whether the vehicle immobilizing device has been armed, self diagnostics to evaluate the operability of the vehicle immobilizing device, and wireless or wired controllers for remotely arming of the vehicle immobilizing device from a suitable distance. Moreover, embodiments according to the present disclosure can include reinforcements to withstand heavy vehicles passing over the vehicle immobilizing device or can include features for protecting the vehicle immobilizing device from exposure to various environments such as water or sand. Further, embodiments according to the present disclosure can be sized in accordance with the terrain and intended implementation of the vehicle immobilizing device, e.g., extending across a single traffic lane or more than one traffic lane.

From the foregoing, it will be appreciated that specific embodiments of the invention have been described herein for purposes of illustration, but that various modifications can be made without deviating from the spirit and scope of the invention. Accordingly, the invention is not limited by the specific embodiments.

What is claimed is:

1. A netting for impeding movement of an automotive vehicle having rotating wheels, the netting having:

a leading strip along the leading edge of the netting that stretches in a widthwise direction upon becoming entangled with the vehicle; wherein the leading strip includes at least one strip segment coupled to at least a portion of the leading edge of the mesh by rip-stitching;

a lengthwise strip that cinches onto the wheels to seize rotation of the wheels; and a plurality of tethers coupling the netting to a plurality of spikes configured to lodge upon contact with the wheel.

2. The netting of claim 1, wherein the lengthwise strip is secured to the leading widthwise strip.

3. The netting of claim 1 wherein the netting comprises at least one of (1) at least two fiber materials, (2) at least two yarn materials, (3) at least two strand materials, and (4) at least two cord materials.

4. The netting of claim 3 wherein the materials comprise at least two of polyester, polyethylene, and aramids.

5. The netting of claim 1, where the mesh is z-twisted, s-twisted, or braided.

6. A netting for impeding movement of an automotive vehicle having rotating wheels, comprising:

individual meshes configured to be stretched upon becoming wrapped around rotating wheels of a vehicle, having:

a width at least as large as the width between rotating wheels; and a length at least as large as a circumference of a rotating wheel;

a plurality of spikes connected to the netting, the spikes configured to couple to a wheel when contacted against the wheel; and a lengthwise strip intertwined with meshes of the net for minimizing net flaring as the net wraps around a rotating wheel.

7. The netting of claim 6 wherein the netting comprises at least one of (1) at least two fiber materials, (2) at least two yarn materials, (3) at least two strand materials, and (4) at least two cord materials.

8. The netting of claim 7, where the netting is z-twisted, s-twisted or braided.

9. A netting assembly for impeding movement of an automotive vehicle having rotating wheels, comprising:

a netting having individual meshes configured to be stretched upon becoming wrapped around rotating wheels of a vehicle, having:

a width approximately as large as the width between rotating wheels, a length at least as large as a circumference of one of the rotating wheels, and a plurality of tethers coupling a leading strip of the netting to a plurality of individual snagging members; and a housing within which the netting is placed when in use, wherein the housing is positioned in a roadway such that the wheels of an automotive vehicle whose movement is to be impeded will contact the housing.

10. The netting assembly of claim 9, wherein the snagging members are spikes.

11. The netting assembly of claim 9, wherein the netting comprises at least one of (1) at least two fiber materials, (2) at least two yarn materials, (3) at least two strand materials, and (4) at least two cord materials.

12. The netting assembly of claim 9, wherein the netting is z-twisted, s-twisted or braided.

13. The netting assembly of claim 9, wherein the snagging members are arranged in the housing so that at least one of the snagging members contacts against a wheel of the automotive vehicle whose movement is to be impeded.

14. The netting assembly of claim 13, wherein the housing includes an opening through which the netting is pulled out via at least one tether when at least one of the snagging members contacts against a wheel of the automotive vehicle whose movement is to be impeded.

15. The netting assembly of claim 14, wherein the netting is configured to cinch the wheels of a vehicle and impede its motion when the netting is pulled out via at least one tether when at least one of the snagging members contacts against a wheel of the automotive vehicle whose movement is to be impeded.

* * * * *